US010931087B2

(12) United States Patent
Kato

(10) Patent No.: US 10,931,087 B2
(45) Date of Patent: Feb. 23, 2021

(54) IGNITION PLUG, CONTROL SYSTEM, INTERNAL COMBUSTION ENGINE, AND INTERNAL COMBUSTION ENGINE SYSTEM

(71) Applicant: NGK SPARK PLUG CO., LTD., Nagoya (JP)

(72) Inventor: Tomoaki Kato, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 16/321,218

(22) PCT Filed: Mar. 14, 2017

(86) PCT No.: PCT/JP2017/010226
§ 371 (c)(1),
(2) Date: Jan. 28, 2019

(87) PCT Pub. No.: WO2018/025440
PCT Pub. Date: Feb. 8, 2018

(65) Prior Publication Data

US 2019/0165548 A1 May 30, 2019

(30) Foreign Application Priority Data

Aug. 4, 2016 (JP) ..... JP2016-153660

(51) Int. Cl.
*H01T 13/34* (2006.01)
*F01P 3/02* (2006.01)
(Continued)

(52) U.S. Cl.
CPC ..... *H01T 13/34* (2013.01); *F01P 3/02* (2013.01); *F01P 3/16* (2013.01); *F02P 13/00* (2013.01);
(Continued)

(58) Field of Classification Search
CPC ..... H01T 13/34; H01T 13/20; H01T 13/16; H01T 13/36; H01T 21/02; H01T 13/40; F01P 3/02; F01P 3/16; F02P 13/00
See application file for complete search history.

(56) References Cited

U.S. PATENT DOCUMENTS

2001/0002096 A1* 5/2001 Honda ..... H01T 13/20 313/143
2002/0140333 A1* 10/2002 Kato ..... H01T 13/36 313/143
(Continued)

FOREIGN PATENT DOCUMENTS

EP 0 480 670 A1 4/1992
EP 1 107 406 A1 6/2001
(Continued)

OTHER PUBLICATIONS

Communication dated Apr. 10, 2019, from the Japanese Patent Office in counterpart application No. 2019-008610.
(Continued)

*Primary Examiner* — Joseph J Dallo
*Assistant Examiner* — Kurt Philip Liethen
(74) *Attorney, Agent, or Firm* — Sughrue Mion, PLLC

(57) ABSTRACT

An ignition plug includes a tubular insulator, a metallic shell disposed around the outer circumference of the insulator, a center electrode disposed in an axial hole of the insulator, and a ground electrode connected to the forward end of the metallic shell and facing the center electrode. The metallic shell has a threaded portion to be engaged with an internal combustion engine. The relational expression Ss/(Sa+Sb)≥2.6 is satisfied, where Ss is the surface area of an outer circumferential surface of the metallic shell extending from the rear end of the threaded portion to the forward end of the threaded portion, Sa is the surface area of that portion of the metallic shell which is to be exposed to
(Continued)

combustion gas of the internal combustion engine, and Sb is the surface area of that portion of the insulator which is to be exposed to the combustion gas.

6 Claims, 9 Drawing Sheets

(51) Int. Cl.

| | |
|---|---|
| ***F01P 3/16*** | (2006.01) |
| ***F02P 13/00*** | (2006.01) |
| ***H01T 13/20*** | (2006.01) |
| ***H01T 13/16*** | (2006.01) |
| ***H01T 13/36*** | (2006.01) |
| ***H01T 21/02*** | (2006.01) |

(52) U.S. Cl.
CPC ..... *H01T 13/16* (2013.01); *H01T 13/20* (2013.01); *H01T 13/36* (2013.01); *H01T 21/02* (2013.01)

(56) References Cited

U.S. PATENT DOCUMENTS

| | | | | |
|---|---|---|---|---|
| 2009/0071429 | A1 | 3/2009 | Nakayama et al. | |
| 2010/0264823 | A1 | 10/2010 | Suzuki et al. | |
| 2015/0188293 | A1* | 7/2015 | Ozeki | H01T 13/36 313/143 |
| 2015/0207299 | A1* | 7/2015 | Ban | H01T 13/16 313/141 |
| 2015/0295388 | A1* | 10/2015 | Kobayashi | H01T 13/16 313/143 |
| 2017/0194769 | A1* | 7/2017 | Miyawaki | H01T 13/20 |

FOREIGN PATENT DOCUMENTS

| | | | |
|---|---|---|---|
| JP | 57-151015 | A | 9/1982 |
| JP | 58-154868 | U | 10/1983 |
| JP | 59-165392 | A | 9/1984 |
| JP | 6-936836 | A | 4/1994 |
| JP | 9-35849 | A | 2/1997 |
| JP | 9-49483 | A | 2/1997 |
| JP | 2001-155839 | A | 6/2001 |
| JP | 2009-87923 | A | 4/2009 |
| JP | 2009-245716 | A | 10/2009 |
| JP | 2014-175094 | A | 9/2014 |

OTHER PUBLICATIONS

Search Report dated Apr. 25, 2017, issued by the International Searching Authority in counterpart International Patent Application No. PCT/JP2017/010226 (PCT/ISA/210).
Communication dated Oct. 23, 2018, issued by the Japanese Patent Office in counterpart Japanese Patent Application No. 2017-533047.
Communication dated Feb. 5, 2020, from the European Patent Office in counterpart European Application No. 17836547.4.

* cited by examiner (A)

| No. | Dn (mm) | Ls (mm) | Ss ($mm^2$) | Sa ($mm^2$) | Sb ($mm^2$) | R1 =Ss/(Sa+Sb) |
|---|---|---|---|---|---|---|
| 1 | 12 | 32 | 1456.2 | 217.7 | 140.7 | 4.1 |
| 2 | 12 | 26.5 | 1184.7 | 217.7 | 140.7 | 3.3 |
| 3 | 10 | 32 | 1218.5 | 275.9 | 175.2 | 2.7 |
| 4 | 10 | 32 | 1218.5 | 277.8 | 195.7 | 2.6 |
| 5 | 12 | 26.5 | 1184.7 | 275.2 | 173.4 | 2.6 |
| 6 | 12 | 26.5 | 1184.7 | 329.7 | 224.1 | 2.1 |
| 7 | 10 | 19 | 681.5 | 239.5 | 138.6 | 1.8 |

(B)

| No. | Dn (mm) | Ls (mm) | Ss ($mm^2$) | Vv ($mm^3$) | Sa ($mm^2$) | Sb ($mm^2$) | Vc ($mm^3$) | R1 =Ss/(Sa+Sb) | Dv =Vv − Vc ($mm^3$) | Nc | |
|---|---|---|---|---|---|---|---|---|---|---|---|
| 8 | 10 | 32 | 1218.5 | 2046.2 | 275.9 | 175.2 | 164.1 | 2.7 | 1882 | 10 | A |
| 9 | 10 | 32 | 1218.5 | 2046.2 | 207.8 | 134.1 | 108.6 | 3.6 | 1938 | 8 | A |
| 10 | 12 | 23 | 1012.0 | 2048.5 | 277.8 | 182.7 | 88.5 | 2.8 | 1960 | 7 | A |
| 11 | 10 | 35 | 1342.4 | 2248.6 | 277.8 | 182.7 | 165.7 | 2.9 | 2083 | 5 | B |
| 12 | 12 | 26.5 | 1184.7 | 2384.7 | 217.7 | 140.7 | 88.5 | 3.3 | 2296 | 5 | B |
| 13 | 12 | 32 | 1456.2 | 2913.0 | 217.7 | 140.7 | 88.5 | 4.1 | 2824 | 5 | B |

| No. | Ss ($mm^2$) | Vv ($mm^3$) | Sa ($mm^2$) | Sb ($mm^2$) | Vc ($mm^3$) | Sd ($mm^2$) | Se ($mm^2$) | R2 =Sd/Se | TEST RESULTS |
|---|---|---|---|---|---|---|---|---|---|
| 14 | 1398.9 | 3329.0 | 406.7 | 258.5 | 300.5 | 9.4 | 32.1 | 0.29 | A |
| 15 | 1184.7 | 2384.7 | 275.2 | 173.4 | 181.0 | 7.7 | 22.1 | 0.35 | A |
| 16 | 991.3 | 1675.2 | 207.8 | 134.1 | 108.6 | 7.0 | 15.1 | 0.46 | A |
| 17 | 1456.2 | 2913.0 | 329.7 | 224.1 | 238.7 | 11.6 | 22.7 | 0.51 | B |
| 18 | 1218.5 | 1675.2 | 275.2 | 178.9 | 181.0 | 8.8 | 15.1 | 0.58 | B |

FIG. 4

| No. | Dn (mm) | Ls (mm) | Ss ($mm^2$) | Sa ($mm^2$) | Sb ($mm^2$) | R1 =Ss/(Sa+Sb) | F (mm) | TEST RESULTS |
|---|---|---|---|---|---|---|---|---|
| 19 | 12 | 26.5 | 1184.7 | 275.2 | 173.4 | 2.6 | 10.0 | A |
| 20 | 12 | 26.5 | 1184.7 | 217.7 | 140.7 | 3.3 | 7.3 | A |
| 21 | 12 | 32 | 1456.2 | 173.7 | 90.1 | 5.5 | 5.0 | A |
| 22 | 12 | 26.5 | 1184.7 | 169.8 | 85.7 | 4.6 | 4.8 | B |
| 23 | 12 | 26.5 | 1184.7 | 154.5 | 68.1 | 5.3 | 4.0 | B |

IGNITION PLUG, CONTROL SYSTEM, INTERNAL COMBUSTION ENGINE, AND INTERNAL COMBUSTION ENGINE SYSTEM

CROSS REFERENCE TO RELATED APPLICATIONS

This application is a National Stage of International Application No. PCT/JP2017/010226, filed Mar. 14, 2017, claiming priority based on Japanese Patent Application No. 2016-153660, filed Aug. 4, 2016.

TECHNICAL FIELD

The present specification relates to an ignition plug.

BACKGROUND ART

An ignition plug is used to ignite air-fuel mixture in a combustion chamber of an internal combustion engine or the like. The ignition plug includes, for example, a tubular insulator, and a metallic shell disposed around the outer circumference of the insulator. In such an ignition plug, for example, the metallic shell has an external thread formed on an outer circumferential surface thereof. The external thread of the metallic shell is engaged with an internal thread formed on a mounting hole of the internal combustion engine.

PRIOR ART DOCUMENT

Patent Document

Patent Document 1: Japanese Patent Application Laid-Open (kokai) No. 2009-245716

SUMMARY OF THE INVENTION

Problem to be Solved by the Invention

In order to improve the degree of freedom for design of an internal combustion engine, a reduction in the diameter of an ignition plug is preferred. However, as a result of reduction in the ignition plug diameter, defects have arisen in some cases. For example, in some cases, deterioration in thermal resistance has arisen.

The present specification discloses a technique for restraining defects regarding an ignition plug.

Means for Solving the Problem

The present specification discloses, for example, the following application examples.

APPLICATION EXAMPLE 1

An ignition plug comprising:

a tubular insulator having an axial hole extending in a direction of an axial line;

a metallic shell disposed around an outer circumference of the insulator;

a center electrode disposed in the axial hole of the insulator; and a ground electrode connected to a forward end of the metallic shell and facing the center electrode, wherein the metallic shell has a threaded portion to be engaged with a thread ridge of a mounting hole of an internal combustion engine, and a relational expression $Ss/(Sa+Sb) \geq 2.6$ is satisfied, where Ss is a surface area of an outer circumferential surface of the metallic shell extending from a rear end of the threaded portion to a forward end of the threaded portion, Sa is a surface area of that portion of the metallic shell which is to be exposed to combustion gas of the internal combustion engine; and Sb is a surface area of that portion of the insulator which is to be exposed to the combustion gas.

According to this configuration, thermal resistance can be improved.

APPLICATION EXAMPLE 2

An ignition plug according to application example 1, wherein the metallic shell has an inside-diameter-reducing portion whose inside diameter reduces toward a forward-end side;

the insulator has an outside-diameter-reducing portion whose outside diameter reduces toward the forward-end side;

the ignition plug has a packing in contact with the outside-diameter-reducing portion and with the inside-diameter-reducing portion, or the outside-diameter-reducing portion is in direct contact with the inside-diameter-reducing portion; and a relational expression $F \geq 5.0$ mm is satisfied, where F is a distance in the direction of the axial line from a forward end of a contact portion between the outer circumferential surface of the insulator and the inside-diameter-reducing portion or the packing to the forward end of the metallic shell.

According to this configuration, since a change in temperature is restrained at a contact portion of the outer circumferential surface of the insulator with the inside-diameter-reducing portion or with the packing, durability can be improved.

APPLICATION EXAMPLE 3

An ignition plug according to application example 1 or 2, wherein the metallic shell has an inside-diameter-reducing portion whose inside diameter reduces toward the forward-end side;

the insulator has an outside-diameter-reducing portion whose outside diameter reduces toward the forward-end side;

the ignition plug has a packing in contact with the outside-diameter-reducing portion and with the inside-diameter-reducing portion, or the outside-diameter-reducing portion is in direct contact with the inside-diameter-reducing portion; and a relational expression $(Vv-Vc) \leq 2{,}000$ mm$^3$ is satisfied, where Vv is a volume of a forward-side portion of the metallic shell extending from a rear end of the threaded portion to a forward end of the metallic shell and assumed to be solid, and Vc is a volume of that portion of a space between an inner circumferential surface of the metallic shell and an outer circumferential surface of the insulator, which portion is located on the forward-end side of a forward end of a contact portion between the outer circumferential surface of the insulator and the inside-diameter-reducing portion or the packing.

According to this configuration, fouling resistance can be improved.

APPLICATION EXAMPLE 4

An ignition plug according to any one of application examples 1 to 3, wherein the metallic shell has an inside-diameter-reducing portion whose inside diameter reduces toward the forward-end side;

the insulator has an outside-diameter-reducing portion whose outside diameter reduces toward the forward-end side;

the ignition plug has a packing in contact with the outside-diameter-reducing portion and with the inside-diameter-reducing portion, or the outside-diameter-reducing portion is direct contact with the inside-diameter-reducing portion;

a forward-end-side portion of the insulator is disposed on the forward-end side of a forward end of the metallic shell; and a relational expression $Sd/Se \leq 0.46$ is satisfied, where Sd is a projected area of that portion of the insulator which is disposed on the forward-end side of the forward end of the metallic shell and is projected in a direction perpendicular to the direction of the axial line, and Se is a sectional area of the insulator taken perpendicularly to the direction of the axial line at a forward end of a contact portion between the outer circumferential surface of the insulator and the inside-diameter-reducing portion or the packing.

According to this configuration, durability can be improved.

APPLICATION EXAMPLE 5

A control system for controlling an internal combustion engine having an ignition plug according to any one of application examples 1 to 4 and a coolant passage for cooling the ignition plug, comprising:

a flow control section for controlling a flow per unit time of coolant flowing through the coolant passage; and a temperature sensor for measuring temperature of the internal combustion engine, wherein if the temperature measured by the temperature sensor is equal to or less than a threshold value, the flow control section reduces the flow as compared with a case where the temperature is higher than the threshold value.

According to this configuration, thermal resistance and fouling resistance can be improved.

APPLICATION EXAMPLE 6

An internal combustion engine comprising:

a coolant passage through which coolant flows;

a hole formation portion which forms a mounting hole for mounting an ignition plug; and an ignition plug according to any one of application examples 1 to 4 and mounted in the mounting hole, wherein the hole formation portion forms the mounting hole extending through the coolant passage, and a portion of the metallic shell of the ignition plug is exposed to the interior of the coolant passage.

According to this configuration, thermal resistance can be improved.

APPLICATION EXAMPLE 7

An internal combustion engine system comprising:

an internal combustion engine according to application example 6, and a control system according to application example 5 and adapted to control the internal combustion engine.

According to this configuration, thermal resistance and fouling resistance can be improved.

The technique disclosed in the present specification can be implemented in various forms; for example, an ignition plug, as internal combustion engine having the ignition plug, a control system for the internal combustion engine, an internal combustion engine system having the internal combustion engine and the control system, and a vehicle having the internal combustion engine system.

BRIEF DESCRIPTION OF THE DRAWINGS

FIG. 4 Explanatory table showing the results of an evaluation test.

MODES FOR CARRYING OUT THE INVENTION

A. First Embodiment

Figure 1:
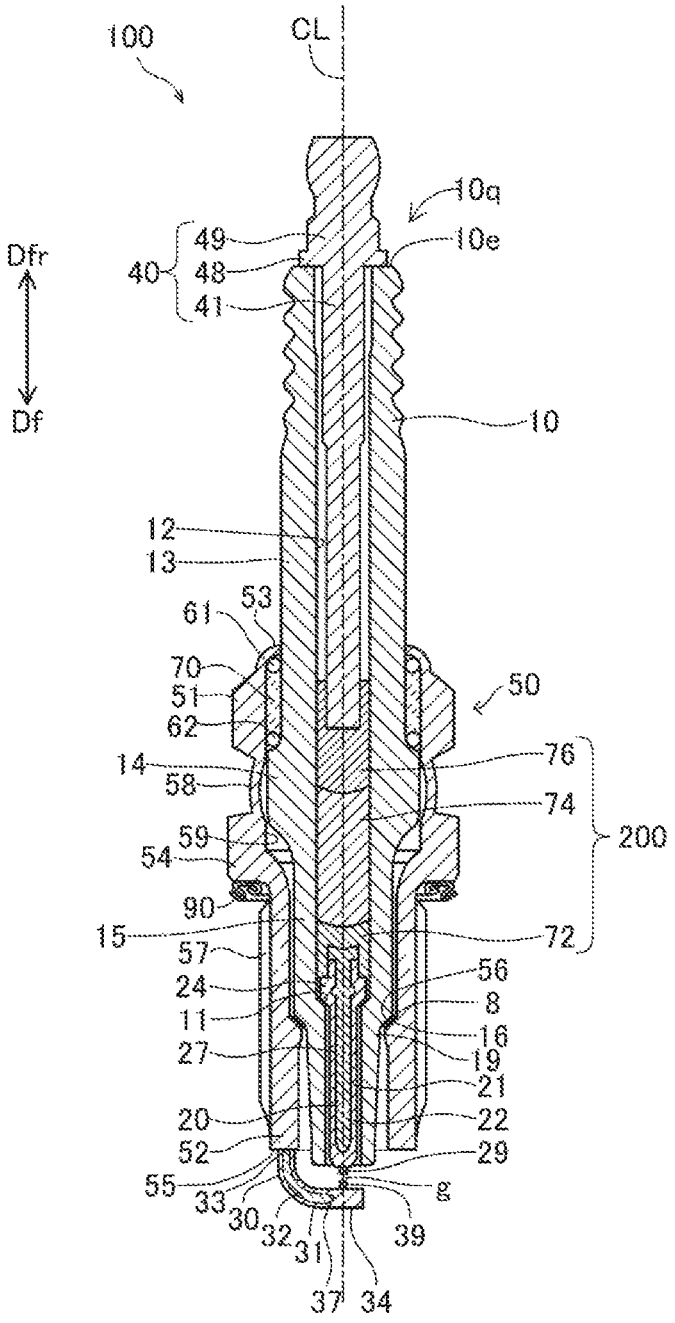
FIG. 1 Sectional view showing an ignition plug 100 according to an embodiment of the present invention.

A-1. Configuration of Ignition Plug 100:

FIG. 1 is a sectional view showing an ignition plug 100 according to an embodiment of the present invention. The drawing illustrates a center axis CL (also called "axial line CL") of the ignition plug 100, and a flat section of the ignition plug 100 which contains the center axis CL. Hereinafter, a direction in parallel with the center axis CL is called the "direction of the axial line CL" and may also be called merely the "axial line direction" or the "forward-rearward direction." A direction perpendicular to the axial line CL is called a "radial direction." Regarding the direction in parallel with the center axis CL, the downward direction in FIG. 1 is called a forward-end direction Df or a forward direction Df, and the upward direction is called a rear-end direction Dfr or a rearward direction Dfr. The forward-end direction Df is directed from a metal terminal member 40 toward a center electrode 20, these members being described later. A forward-end direction Df side in FIG. 1 is called a forward-end side of the ignition plug 100, and a rear-end direction Dfr side in FIG. 1 is called a rear-end side of the ignition plug 100.

The ignition plug 100 has a tubular insulator 10 having a through hole 12 (may also be called an axial hole 12) extending along the axial line CL, a center electrode 20 held in the through hole 12 at the forward-end side, a metal terminal member 40 held in the through hole 12 at the rear-end side, a resistor 74 disposed within the through hole 12 between the center electrode 20 and the metal terminal member 40, a first seal 72 electrically connecting the resistor 74 and the center electrode 20, a second seal 76 electrically connecting the resistor 74 and the metal terminal member 40, a tubular metallic shell 50 fixed to the outer circumference of the insulator 10, and a ground electrode 30 whose one end is joined to a forward end surface 55 of the metallic shell 50 and whose other end faces the center electrode 20 with a gap g formed therebetween.

The insulator 10 has a large-diameter portion 14 having the largest outside diameter and formed at an approximately axial center. The insulator 10 has a rear-end-side trunk portion 13 formed on the rear-end side of the large-diameter portion 14. The insulator 10 has a forward-end-side trunk portion 15 formed on the forward-end side of the large-diameter portion 14 and having arm outside diameter smaller than that of the rear-end-side trunk portion 13. The insulator 10 has an outside-diameter-reducing portion 16 and a leg portion 19 formed on the forward-end side of the forward-end-side trunk portion 15 in this order toward the forward-end side. The outside diameter of the outside-diameter-reducing portion 16 gradually reduces in the forward direction Df. The insulator 10 has an inside-diameter-reducing portion 11 formed in the vicinity of the outside-diameter-reducing portion 16 (in the example of FIG. 1, the forward-end-side trunk portion 15) and whose inside diameter gradually reduces in the forward direction Df. The insulator 10 is formed preferably in consideration of mechanical strength, thermal strength, and electrical strength and is formed, for example, by firing alumina (other electrically insulating materials can be employed).

The center electrode 20 is a rodlike member extending from the rear-end side toward the forward-end side. The center electrode 20 is disposed in the through hole 12 of the insulator 10 at a forward direction Df side end portion. The center electrode 20 has a head portion 24 having the largest outside diameter, a shaft portion 27 formed on the forward direction Df side of the head portion 24, and a first tip 29 joined (e.g., laser-welded) to the forward end of the shaft portion 27. The outside diameter of the head portion 24 is greater than the inside diameter of a portion of the insulator 10 located on the forward direction Df side of the inside-diameter-reducing portion 11. The forward direction Df side surface of the head portion 24 is supported by the inside-diameter-reducing portion 11 of the insulator 10. The shaft portion 27 extends in the forward direction Df in parallel with the axial line CL. The shaft portion 27 has an outer layer 21 and a core 22 disposed on the inner-circumference side of the outer layer 21. The outer layer 21 is formed of, for example, an alloy which contains nickel as a main component. The main component means a component having the highest content (weight %). The core 22 is formed of a material (e.g., an alloy which contains copper as a main component) higher in thermal conductivity than the outer layer 21. The first tip 29 is formed by use of a material (e.g., a noble metal such as iridium (Ir), platinum (Pt), or the like, tungsten (W), or an alloy which contains at least one of these metals) superior to the shaft portion 27 in durability against discharge. A forward-end-side portion including the first tip 29 of the center electrode 20 protrudes from the axial hole 12 of the insulator 10 toward the forward direction Df side. At least one of the core 22 and the first tip 29 may be eliminated. Also, the entire center electrode 20 may be disposed within the axial hole 12.

A forward direction Df side portion of the metal terminal member 40 is inserted into the rear-end side of the through hole 12 of the insulator 10. The metal terminal member 40 is a rodlike member extending in parallel with the axial line CL. The metal terminal member 40 is formed by use of an electrically conductive material (e.g., a metal which contains iron as a main component). The metal terminal member 40 has a cap attachment portion 49, a collar portion 48, and a shaft portion 41 disposed sequentially in the forward direction Df. The cap attachment portion 49 is disposed outside the axial hole 12 on the rear-end side of the insulator 10. A plug cap connected to a high-voltage cable (not shown) is fitted to the cap attachment portion 49 for application of high voltage for generation of spark discharge. The cap attachment portion 49 is an example of a terminal portion to which a high-voltage cable is connected. The shaft portion 41 is inserted into a rearward direction Dfr portion of the axial hole 12 of the insulator 10. The forward direction Df side surface of the collar portion 48 is in contact with the rearward direction Dfr side end, or a rear end 10*e*, of the insulator 10.

The resistor 74 is disposed within the axial hole 12 of the insulator 10 between the metal terminal member 40 and the center electrode 20 for restraining electrical noise. The resistor 74 is formed by use of an electrically conductive material (e.g., a mixture of glass, carbon particles, and ceramic particles). The first seal 72 is disposed between the resistor 74 and the center electrode 20, and the second seal 76 is disposed between the resistor 74 and the metal terminal member 40. These seals 72 and 76 are formed by use of an electrically conductive material (e.g., a mixture of metal particles and glass similar to that contained in the material of the resistor 74). The center electrode 20 is electrically connected to the metal terminal member 40 by means of the first seal 72, the resistor 74, and the second seal 76. Hereinafter, the first seal 72, the resistor 74, and the second seal 76 which electrically connect the metal terminal member 40 and the center electrode 20 within the axial hole 12 of the insulator 10 may also be collectively called a connection member 200.

In manufacture of the ignition plug 100, the center electrode 20 is inserted into the insulator 10 from a rearward direction Dfr side opening 10*q* of the insulator 10. The center electrode 20 is supported by the inside-diameter-reducing portion 11 of the insulator 10 to thereby be disposed at a predetermined position within the through hole 12. Next, material powders of the first seal 72, the resistor 74, and the second seal 76 are charged, and the charged material powders are compacted, in the order of the members 72, 74, and 76. The material powders are charged into the through hole 12 from the opening 10*q*. Next, the insulator 10 is heated to a predetermined temperature higher than the softening temperature of a glass component contained in the material powders of the members 72, 74, and 76; then, in a state in which the insulator 10 is heated to the predetermined temperature, the shaft portion 41 of the metal terminal member 40 is inserted into the through hole 12. As a result, the material powders of the members 72, 74, and 76 are compressed and sintered, thereby forming the members 72, 74, and 76. Further, the metal terminal member 40 is fixed to the insulator 10.

The metallic shell 50 is a tubular member having a through hole 59 extending along the axial line CL. The insulator 10 is inserted into the through hole 59 of the metallic shell 50, and the metallic shell 50 is fixed to the outer circumference of the insulator 10. The metallic shell 50 is formed by use of an electrically conductive material (e.g., a metal such as low-carbon steel or the like). A forward direction Df side portion of the insulator 10 protrudes outward from the through hole 59. Also, a rearward direction Dfr side portion of the insulator 10 protrudes outward from the through hole 59.

The metallic shell 50 has a tool engagement portion 51 and a trunk portion 52. The tool engagement portion 51 allows an ignition plug wrench (not shown) to be fitted thereto. The trunk portion 52 includes the forward end surface 55 of the metallic shell 50. The trunk portion 52 has a threaded portion 57 formed on the outer circumferential surface thereof and adapted to be threadingly engaged with a mounting hole of an internal combustion engine (e.g., a gasoline engine). The threaded portion 57 is an external thread and has a spiral thread ridge (not illustrated).

The metallic shell 50 has a flange-like collar portion 54 formed between the tool engagement, portion 51 and the trunk portion 52 and protruding radially outward. An annular gasket 90 is disposed between the collar portion 54 and the threaded portion 57 of the trunk portion 52. The gasket 90 is formed by, for example, folding a plate-like member of metal, and, when the ignition plug 100 is mounted to an engine, the gasket 90 is crushed and deformed. As a result of deformation of the gasket 90, a gap between the ignition plug 100 (specifically, the forward direction Df side surface of the collar portion 54) and the engine is sealed, whereby outward leakage of combustion gas is restrained.

The trunk portion 52 of the metallic shell 50 has an inside-diameter-reducing portion 56 whose inside diameter gradually reduces toward the forward-end side. A forward-end-side packing 8 is held between the inside-diameter-reducing portion 56 of the metallic shell 50 and the outside-diameter-reducing portion 16 of the insulator 10. In the present embodiment, the forward-end-side packing 8 is, for example, a plate-like ring made of iron (other materials (e.g., metal materials such as copper, etc.) can be employed).

The metallic shell 50 has a thin-walled crimp portion 53 formed on the rear-end side of the tool engagement portion 51. Also, the metallic shell 50 has a thin buckled portion 58 between the flange-like collar portion 54 and the tool engagement portion 51. Annular ring members 61 and 62 are inserted between an inner circumferential surface of the metallic shell 50 extending from the tool engagement portion 51 to the crimp portion 53 and an outer circumferential surface of the rear-end-side trunk portion 13 of the insulator 10. Further, powder of talc 70 is charged between these ring members 61 and 62. In the manufacturing process of the ignition plug 100, when the crimp portion 53 is formed through radially inward bending for crimping, associated application of compressive force forms the buckled portion 58 through radially outward deformation (buckling); as a result, the metallic shell 50 and the insulator 10 are fixed together. In this crimping step, the talc 70 is compressed, thereby enhancing airtightness between the metallic shell 50 and the insulator 10. The packing 8 is pressed between the outside-diameter-reducing portion 16 of the insulator 10 and the inside-diameter-reducing portion 56 of the metallic shell 50, thereby providing a seal between the metallic shell 50 and the insulator 10.

The ground electrode 30 has a rodlike body portion 37 and a second tip 39 attached to a distal end portion 34 of the body portion 37. One end portion 33 (also called a proximal end portion 33) of the body portion 37 is joined to the forward end surface 55 of the metallic shell 50 (for example, resistance welding). The body portion 37 extends in the forward-end direction Df from the proximal end portion 33 joined to the metallic shell 50, is bent toward the center axis CL, and reaches the distal end portion 34. The second tip 39 is fixed (e.g., laser-welded) to a rearward direction Dfr side portion of the distal end portion 34. The second tip 39 of the ground electrode 30 and the first tip 29 of the electrode 20 form the gap g therebetween. The second tip 39 is formed by use of a material (e.g., a noble metal such as iridium (Ir), platinum (Pt), or the like, tungsten (W), or an alloy which contains at least one of these metals) superior to the body portion 37 in durability against discharge. The body portion 37 has an outer layer 31 and an inner layer 32 disposed on the inner-circumference side of the outer layer 31. The outer layer 31 is formed of a material (e.g., an alloy which contains nickel) superior to the inner layer 32 in oxidization resistance. The inner layer 32 is formed of a material (e.g., pure copper, a copper alloy, or the like) higher in thermal conductivity than the outer layer 31. At least one of the inner layer 32 and the second tip 39 may be eliminated.

Figures 2, 3:
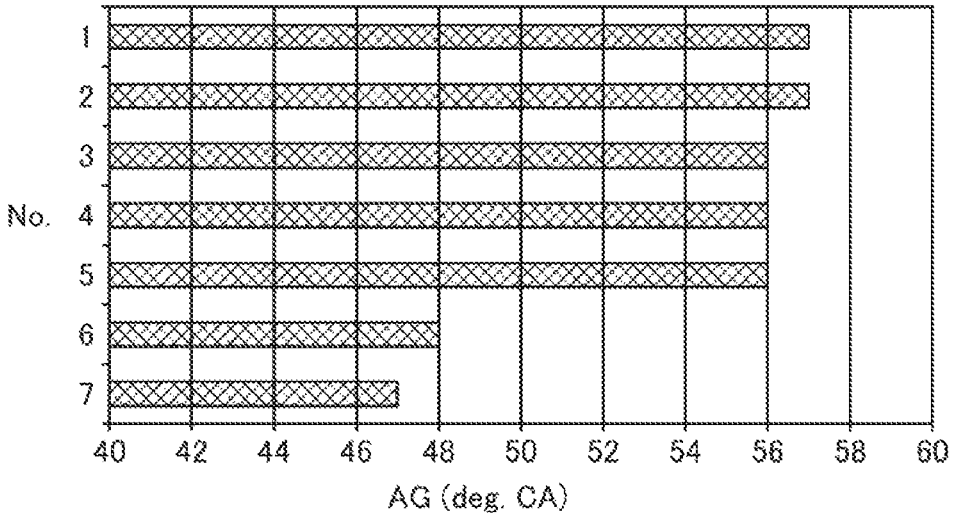
FIG. 2 Explanatory table and graph showing the results of an evaluation test.
FIG. 3 Explanatory table showing the results of an evaluation test.

B. Evaluation Tests:

FIGS. 2 to 4 are explanatory tables and graph showing the results of evaluation tests using samples of the ignition plug. FIG. 2(A) is a table showing the configurations of samples No. 1 to No. 7. This table shows nominal diameter Dn [mm], screw length Ls [mm], metallic-shell contact area Ss [$mm^2$], metallic-shell exposed area Sa [$mm^2$], insulator exposed area Sb [$mm^2$], and first area ratio R1 (=Ss/(Sa+Sb)) (unit appears in brackets) with respect to the samples. Samples Nos. 1 to 7 differ in at least one of Ss, Sa, and Sb. FIG. 2(B) is a graph showing advance angle of preignition occurrence AG (hereinafter, may also be called merely advance angle of occurrence AG) with respect to samples Nos. 1 to 7. The vertical axis indicates sample No., and the horizontal axis indicates advance angle of occurrence AG. In FIG. 2(B), advance angle of occurrence AG is represented by crank angle, and its unit is degrees. Samples Nos. 1 to 7 were evaluated for resistance to occurrence of preignition (i.e., thermal resistance).

Figure 5:
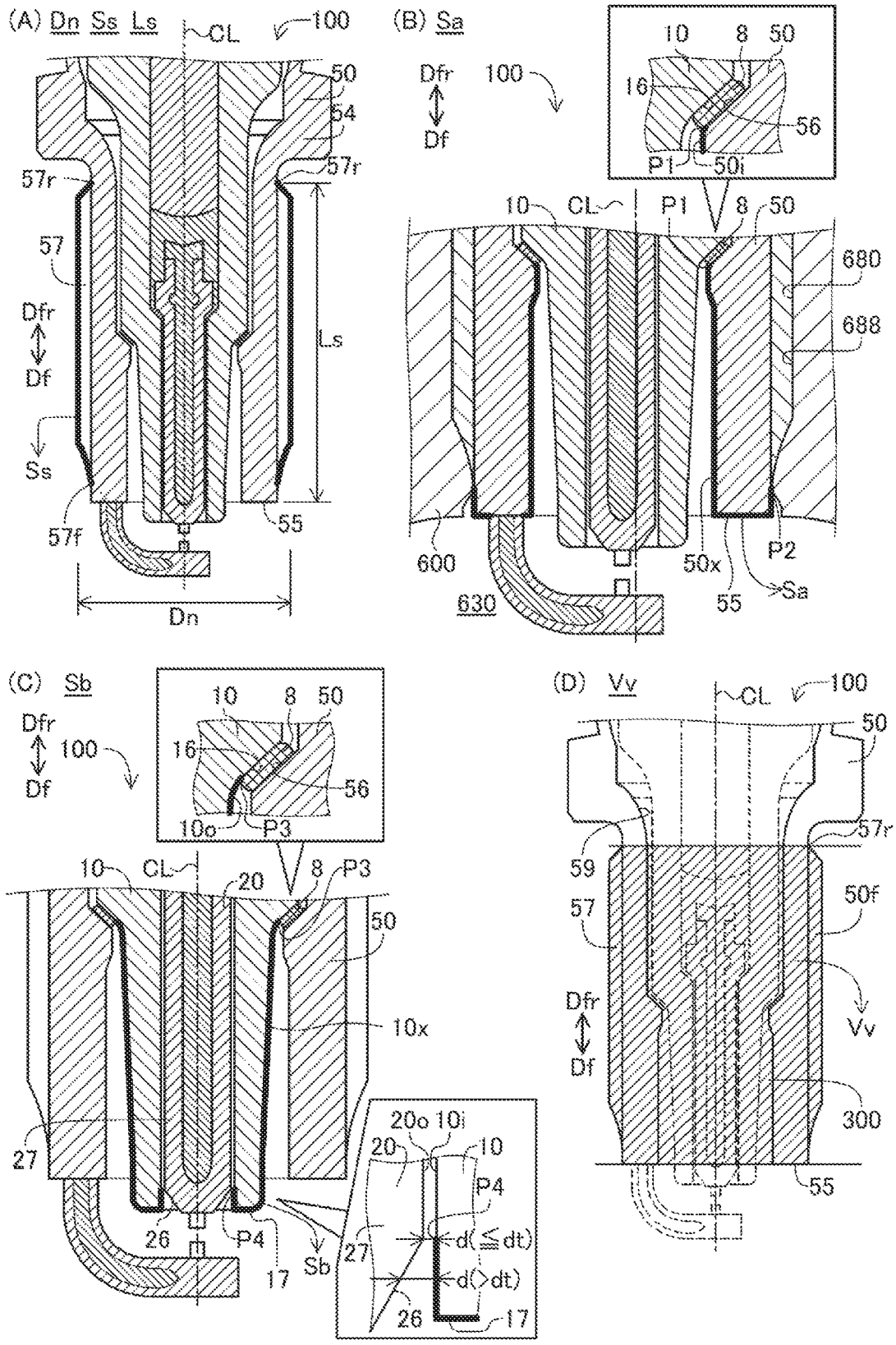
FIG. 5 Explanatory views for explaining parameters Dn, Ss, Ls, Sa, Sb, and Vv.

FIG. 5(A) is an explanatory view for explaining nominal diameter Dn, screw length Ls, and metallic-shell contact area Ss. The drawing shows the section of a forward direction Df side portion of the ignition plug 100 which contains the axial line CL. Nominal diameter Dn is of the threaded portion 57 of the metallic shell 50. Screw length Ls is a length in parallel with the axial line CL from a rear end **57*r* of the threaded portion 57 to the forward end (herein, the forward end surface 55) of the metallic shell 50. The rear end 57*r* of the threaded portion 57 is the most rearward direction Dfr side end of the thread ridge or root of the threaded portion 57. The drawing also shows a forward end 57*f* of the threaded portion 57. The forward end 57*f* of the threaded portion 57 is the most forward direction Df side end of the thread ridge or root of the threaded portion 57**.

Metallic-shell contact area Ss is the surface area of the outer circumferential surface of a portion of the metallic shell 50 ranging from the rear end **57*r* of the threaded portion 57 to the forward end. 57*f* of the threaded portion 57 (in FIG. 5(A), the portion is indicated by the bold lines). Metallic-shell contact area Ss indicates the area of that portion of the metallic shell 50 which is in contact with another member (e.g., a hole formation portion which forms a mounting hole of an internal combustion engine). In the course of driving of the internal combustion engine, combustion gas comes into contact with a forward direction Df side portion of the ignition plug 100. Heat is transmitted from combustion gas to the ignition plug 100 and then from the ignition plug 100 to the hole formation portion of the internal combustion engine through the threaded portion 57. Since the greater the metallic-shell contact area Ss, the more likely the transmission of heat from the ignition plug 100 to the internal combustion engine, the ignition plug 100 is likely to be cooled. Notably, the surface area of the threaded portion 57** having a spiral thread ridge and root was calculated by use of the surface area calculation formula described in Annex B of IEC62321.

FIG. 5(B) is an explanatory view for explaining metallic-shell exposed area Sa. The drawing shows the section of a forward direction Df side portion of the ignition plug 100 mounted in a mounting hole 680 of an internal combustion engine 600 which contains the axial line CL. The forward direction Df side portion of the ignition plug 100 is exposed to combustion gas in a combustion chamber 630. The metallic-shell exposed area Sa is the area of a portion 50*x* to be exposed to combustion gas of the surface of the metallic shell 50. In the drawing, the portion. 50*x* (also called the exposed portion 50*x*) is indicated by the bold lines. In the course of driving of the internal combustion engine, the exposed portion 50*x* comes into contact with combustion gas. Heat is transmitted from combustion gas to the metallic shell 50. Since the greater the metallic-shell exposed area Sa, the more likely the transmission of heat from combustion gas to the metallic shell 50, the temperature of the metallic shell 50 (and, in turn, the ignition plug 100) is likely to increase.

The exposed portion 50*x* extends from a first position P1 on the inner circumferential surface of the metallic shell 50 to a second position P2 on the outer circumferential surface of the metallic shell 50 by way of the forward end surface 55 of the metallic shell 50. FIG. 5(B) includes an enlarged sectional view located in its upper region and showing a portion which includes the packing 8. The first position P1 is the most forward direction Df side position (i.e., the forward end) of a contact portion between the packing 8 and an inner circumferential surface 50*i* of the metallic shell 50. The second position P2 is the most forward direction Df side position (i.e., the forward end) of a contact portion between the outer circumferential surface of the metallic shell 50 and a hole formation portion 688 of the internal combustion engine 600. The hole formation portion 688 forms a mounting hole 680 for mounting the ignition plug 100.

FIG. 5(C) is an explanatory view for explaining insulator exposed area Sb. The drawing shows the section of a forward direction Df side portion of the ignition plug 100 which contains the axial line CL. Insulator exposed area Sb is the area of a portion 10*x* to be exposed to combustion gas of the surface of the insulator 10. In the drawing, the portion 10*x* (also called the exposed portion 10*x*) is indicated by the bold line. In the course of driving of the internal combustion engine, combustion gas comes into contact with the exposed portion 10*x*. Heat is transmitted from combustion gas to the insulator 10. Since the greater the insulator exposed area Sb, the more likely the transmission of heat from combustion gas to the insulator 10, the temperature of the insulator 10 (and, in turn, the ignition plug 100) is likely to increase.

The exposed portion 10*x* extends from a third position P3 on the outer circumferential surface of the insulator 10 to a fourth position P4 on the inner circumferential surface of the insulator 10 by way of a forward end 17 of the insulator 10. FIG. 5(C) includes an enlarged sectional view located in its upper region and showing the portion which includes the packing 8. The third position P3 is the most forward direction Df side position (i.e., the forward end) of a contact portion between the packing 8 and an outer circumferential surface 10*o* of the insulator 10.

FIG. 5(C) includes an enlarged sectional view located in its lower region and showing a forward end portion of the gap between the insulator 10 and the center electrode 20. Distance d in the drawing is a distance in a direction perpendicular to the axial line CL between an inner circumferential surface 10*i* of the insulator 10 and an outer circumferential surface 20*o* of the center electrode 20. Combustion gas can enter the gap between the inner circumferential surface 10*i* of the insulator 10 and the outer circumferential surface 20*o* of the center electrode 20. In the case of a distance d greater tan a predetermined threshold value dt (herein, 0.1 mm), combustion gas is likely to enter, and in the case of a distance d equal to or less than the threshold value dt, combustion gas is unlikely to enter. The fourth position P4 is the most forward direction Df side position on that portion of the inner circumferential surface 10*i* of the insulator 10 at which distance d is equal to or less than the threshold value dt.

In the example of FIG. 5(C), the shaft portion 27 of the center electrode 20 has an outside-diameter-reducing portion 26 whose outside diameter reduces in the forward direction Df from the inside of the axial hole 12 of the insulator 10 toward the outside of the axial hole 12. Therefore, the fourth position P4 faces a rearward direction Dfr side end portion of the outside-diameter-reducing portion 26. In the case of elimination of such the outside-diameter-reducing portion 26, the fourth position P4 located at the inner-circumference side end of the exposed portion 10*x* is not located on the inner circumferential surface 10*i* of the insulator 10, but can be located at the inner circumferential edge of the forward end 17 of the insulator 10.

First area ratio R1 (=Ss/(Sa+Sb)) appearing in the table of FIG. 2(A) is the ratio of area Ss of that portion (mainly the threaded portion 57) of the surface of the ignition plug 100 which transmits heat to another member (herein, the hole formation portion 688 of the internal combustion engine 600) to total area (Sa+Sb) of those surface portions 50*x* and 10*x* of the ignition plug 100 which receive heat from combustion gas. Since the greater the first area ratio R1, the more likely the cooling of the ignition plug 100, the occurrence of defects (e.g., preignition) caused by an increase in temperature of the ignition plug 100 can be restrained.

FIG. 2(B) shows the results of a preignition test conducted on the basis of JIS D1606. The outline of the preignition test is as follows. The samples are mounted on a 4-cylinder DOHC (Double OverHead Camshaft) engine of 1.3 L displacement, and the engine is operated at a rotational speed of 6,000 rpm with full throttle opening. In this condition, ignition timing is advanced a predetermined angle by a predetermined angle from the regular ignition timing. At timing prior to individual ignition timings, current which flows through the electrodes 20 and 30 (also called ion current) is measured. Usually, ion current at timing prior to an ignition timing is about zero. Large ion current measured at timing prior to an ignition timing indicates that ions are generated in the vicinity of the electrodes 20 and 30; i.e., flame (i.e., preignition) is generated in the vicinity of the electrodes 20 and 30. With respect to the samples, ignition timing at which preignition has occurred (advance angle of occurrence AG) was identified on the basis of the waveform of current flowing through the electrodes 20 and 30. The greater the advance angle of occurrence AG, the less likely the occurrence of preignition; i.e., the better the thermal resistance.

As shown in FIG. 2(B), samples Nos. 1 to 5 had an advance angle of occurrence AG of 56 degrees or greater, and samples Nos. 6 and 7 had an advance angle of occurrence AG of 48 degrees or less. In this manner, samples Nos. 1 to 5 were greatly superior in thermal resistance to samples Nos. 6 and 7. Also, as shown in FIG. 2(A), samples Nos. 1 to 5 had a first area ratio R1 of 2.6 or greater; specifically, 4.1, 3.3, 2.7, 2.6, and 2.6, respectively. Samples Nos. 6 and 7 had a first area ratio R1 of less than 2.6; specifically, 2.1 and 1.8, respectively. In this manner, thermal resistance was greatly improved at a first area ratio R1 of 2.6 or greater as compared with the case of a first area ratio R1 of less than 2. The conceivable reason for exhibition of good thermal resistance at large first area ratio R1 is as follows: as mentioned above, the greater the first area ratio R1, the more likely the cooling of the ignition plug 100, whereby an increase in temperature of the ignition plug 100 is restrained.

At a first area ratio R1 of 2.6, 2.7, 3.3, and 4.1, an advance angle of occurrence AG of 56 degrees or greater was realized. A preferred range (a range of a lower limit to an upper limit) of first area ratio R1 may be determined by use of the four values. Specifically, any one of the above-mentioned four values may be employed as the lower limit of the preferred range of first area ratio R1. For example, first area ratio R1 may be 2.6 or greater. Of these values, any one equal to or greater than the lower limit may be employed as the upper limit of the preferred range of first area ratio R1. For example, first area ratio R1 may be 4.1 or less. Since the greater the first area ratio R1, the greater the extent to which an increase in temperature of the ignition plug 100 is restrained, the greater the first area ratio R1, the greater the restraint of occurrence of defects (e.g., preignition) caused by an increase in temperature of the ignition plug 100. Therefore, first area ratio R1 may be greater than 4.1 which is the greatest one of the above-mentioned four values. In a low-temperature environment, in order to accelerate an increase in temperature of the ignition plug 100, it is preferred that first area ratio R1 be small. For example, a first area ratio R1 of 5.2 or less is preferred.

Since thermal resistance evaluated by the present evaluation test is related to ease of cooling of the ignition plug, conceivably, influence of first area ratio R1 on thermal resistance is large, whereas influence of other parameters (e.g., Dn, Ls, Ss, Sa, Sb, etc.) is relatively small. Therefore, the above-mentioned preferred range of first area ratio R1 is conceivably applicable to ignition plugs having various values of parameters (e.g., Dn, Ls, Ss, Sa, Sb, etc.).

FIG. 3 is a table showing the configurations of samples Nos. 8 to 13 and the test results. This table shows nominal diameter Dn [mm], screw length Ls [mm], metallic-shell contact area. Ss [$mm^2$], solid volume Vv [$mm^3$], metallic-shell exposed area Sa [$mm^2$], insulator exposed area Sb [$mm^2$], space volume Vc [$mm^3$], first area ratio R1, volume difference Dv [$mm^3$], and test results (specifically, number of cycles Nc and their evaluation results) (unit appears in brackets), with respect to the samples. Samples Nos. 8 to 13 differ in at least one of Vv and Vc. Samples Nos. 8 to 13 underwent an evaluation test on fouling resistance, which will be described herein later.

FIG. 5(D) is an explanatory view for explaining solid volume Vv. The drawing shows the section of a forward direction Df side portion of the ignition plug 100 which contains the axial line CL. Solid volume Vv is the volume of an imaginarily solid forward-end-side portion 50*f* ranging from the rear end 57*r* of the threaded portion 57 of the metallic shell 50 to the forward end (herein, the forward end surface 55) of the metallic shell 50. That is, solid volume Vv is the volume of the forward-end-side portion 50*f* on the assumption that a portion of the through hole 59 of the metallic shell 50 corresponding to the forward-end-side portion 50*f* is fully solid. Hereinafter, a portion corresponding to solid volume Vv may also be called an imaginary forward-end-side portion 300.

Figure 6:
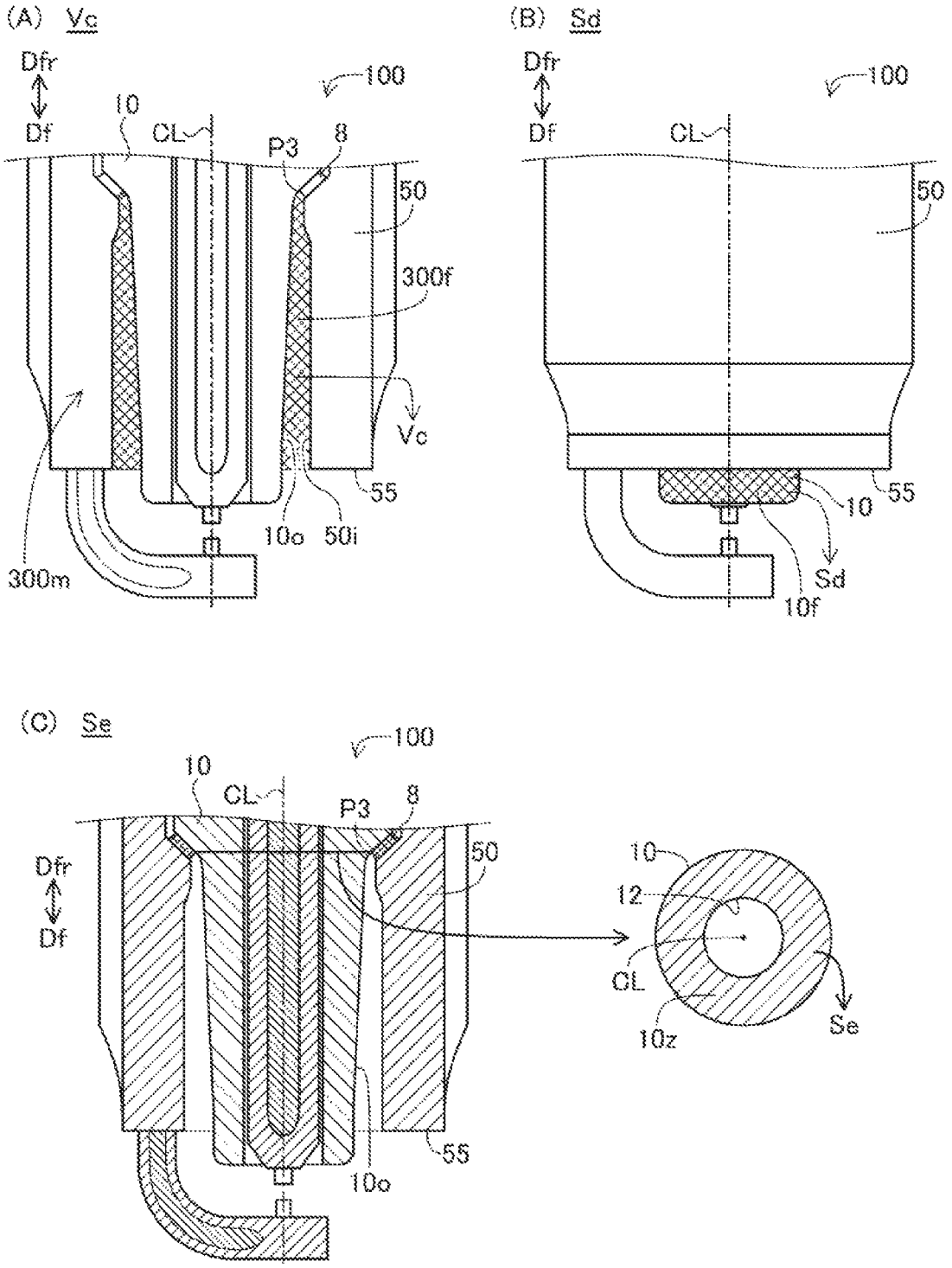
FIG. 6 Explanatory views for explaining parameters Vc, Sd, and Se.

FIG. 6(A) is an explanatory view for explaining space volume Vc. The drawing shows the section of a forward direction Df side portion of the ignition plug 100 which contains the axial line CL. Space volume Vc is the volume of that forward-end-side space portion 300*f* of the space defined by the inner circumferential surface 50*i* of the metallic shell 50 and the outer circumferential surface 10*o* of the insulator 10 which is located on the forward direction Df side of the above-mentioned third position P3. In the drawing, the forward-end-side space portion 300*f* is hatched, whereas the remaining members are not hatched. The forward-end-side space portion 300*f* is a portion of the space defined by the inner circumferential surface 50*i* of the metallic shell 50 and the outer circumferential surface 10*o* of the insulator 10 into which combustion gas can enter. The forward-end-side space portion 300*f* is approximately identical to a space portion which remains by removing members of the ignition plug 100 from the imaginary forward-end-side portion 300 described above with reference to FIG. 5(D). Third position P3 is also the position of the rearward direction Dfr side end of the forward-end-side space portion 300*f*.

Volume difference Dv (=Vv−Vc) appearing in the table of FIG. 3 indicates the volume of a portion 300*m* (FIG. 6(A)) remaining after removing the forward-end-side space portion 300*f* (FIG. 6(A)) where members of the ignition plug 100 are not disposed, from the imaginary forward-end-side portion 300 (FIG. 5(D)). This portion 300*m* (hereinafter, may also be called the forward-end-side member portion 300*m*) is approximately identical to that portion of the imaginary forward-end-side portion 300 where members of the ignition plug 100 are disposed. Volume difference Dv (hereinafter, may also be called merely volume Dv) indicates an approximate volume of the forward-end-side member portion 300*m*.

The forward-end-side member portion 300*m* (FIG. 6(A)) of the ignition plug 100 receives heat from combustion gas and transmits heat to the hole formation portion 688 (FIG. 5(B)) of an internal combustion engine. A small value of volume Dv of the forward-end-side member portion 300*m* performing such transmission of heat indicates a small heat capacity of the forward-end-side member portion 300*m*. Therefore, since the smaller the volume Dv, the more likely the increase in temperature of the forward-end-side member portion 300*m* of the ignition plug 100, the smaller the volume Dv, the greater the restraint of the occurrence of defects (e.g., fouling by carbon) caused by low temperature of the ignition plug 100.

FIG. 3 shows the results (number of cycles Nc and their evaluation results) of a fouling resistance evaluation test conducted on the basis of JIS D1606. The outline of this evaluation test is as follows. A test automobile having a naturally aspirated 4-cylinder MPI (MultiPoint fuel Injection) engine of 1.6 L displacement was placed on a chassis dynamometer disposed within a low-temperature testing room having a temperature of −10 degrees C. Ignition plug samples were mounted in the respective cylinders of the engine of the test automobile. In the test, one-cycle test operation consisted of a first operation and a subsequent second operation. The first operation sequentially conducts "three times of racing," "a 40-second run at 35 km/h with the third gear position," "90-second idling," "a 40-second run at 35 km/h with the third gear position," "engine stop," and "cooling of automobile until the temperature of cooling water becomes −10 degrees C." The second operation sequentially conducts "three times of racing," "three 20-second runs at 15 km/h with the first gear position with 30-second engine halts therebetween," "engine stop," and "cooling of automobile until the temperature of cooling water becomes −10 degrees C."

The test operation consisting of the first operation and the second operation was repeated. Every time one-cycle test operation was completed, the ignition plug samples were measured for insulation resistance between the center electrode 20 and the metallic shell 50. Since electric resistance between the metal terminal member 40 and the center electrode 20 is sufficiently small as compared with insulation resistance, a measured insulation resistance between the metal terminal member 40 and the metallic shell 50 was employed as insulation resistance between the center electrode 20 and the metallic shell 50. The number of cycles Nc at the stage in which the average insulation resistance of four samples mounted in the engine became 10 MΩ or less was obtained for individual samples Nos. 8 to 13. As a result of driving of the internal combustion engine, carbon can adhere to the surface of the insulator 10 (called fouling). In the case where such fouling is apt to advance, insulation resistance is apt to drop, and the number of cycles Nc is small. A large number of cycles Nc indicates that fouling of the ignition plug 100 is restrained. Rating A in FIG. 3 indicates that the number of cycles Nc is 6 or greater, and rating B indicates that the number of cycles Nc is 5 or less.

As shown in FIG. 3, samples Nos. 8 to 10 exhibited a number of cycles Nc of 6 or greater (rating A), and samples Nos. 11 to 13 exhibited a number of cycles Nc of 5 or less (rating B). In this manner, samples Nos. 8 to 10 exhibited good fouling resistance as compared with samples Nos. 11 to 13. Also, as shown in FIG. 3, samples Nos. 8 to 10 had a volume difference Dv of 2,000 $mm^3$ or less; specifically, 1,882, 1,938, and 1,960 ($mm^3$), respectively. Samples Nos. 11 to 13 had a volume difference Dv of greater than 2,000 $mm^3$; specifically, 2,083, 2,296, and 2,824 ($mm^3$), respectively. In this manner, the case of a volume difference Dv of 2,000 $mm^3$ or less exhibited greatly improved fouling resistance as compare with the case of a volume difference Dv of greater than 2,000 $mm^3$.

The reason why the case of small volume difference Dv exhibits good fouling resistance is conceivably as follows. As mentioned above, since in the case of small volume difference Dv, the forward-end-side member portion 300*m* (FIG. 6(A)) of the ignition plug 100 is small, even in a low-temperature environment, the temperature of the forward-end-side member portion 300*m* (and, in turn, the temperature of a portion in contact with combustion gas of the insulator 10) is apt to increase. In the case where the insulator 10 has high temperature, carbon adhering to the surface of the insulator 10 can be easily burned away. Thus, in the case of small volume difference Dv, fouling resistance is improved.

A volume difference Dv of 1,882, 1,938, and 1,960 ($mm^3$) exhibited numbers of cycles Nc evaluated as A. A preferred range (a range of a lower limit to an upper limit) of volume difference Dv may be determined by use of these three values. Specifically, any one of the above-mentioned three values may be employed as the upper limit of the preferred range of volume difference Dv. For example, volume difference Dv may be equal to or less than 1,960 $mm^3$. Of these values, any one equal to or less than the upper limit may be employed as the lower limit of the preferred range of volume difference Dv. For example, volume difference Dv may be 1,882 $mm^3$ or greater. Since the smaller the volume difference Dv, the more the acceleration of temperature rise of the insulator 10, the smaller the volume difference Dv, the greater the restraint of occurrence of defects (e.g., fouling by carbon) caused by low temperature of the ignition plug 100. Therefore, volume difference Dv may be smaller than a smallest volume of 1,882 $mm^3$ of the above-mentioned three values. In order to improve durability of a portion of the ignition plug 100 corresponding to the forward-end-side member portion 300*m*, it is preferred that volume difference Dv of the forward-end-side member portion 300*m* be large. For example, a volume difference Dv of 1,000 $mm^3$ or greater is preferred.

As shown in FIG. 3, samples Nos. 8 to 13 have a first area ratio R1 of 2.6 or greater. Therefore, conceivably, under conditions such that the temperature of the ignition plug 100 is apt to increase as in the case of the evaluation test of FIG. 2(A), samples Nos. 8 to 13 can restrain the occurrence of defects (e.g., preignition) caused by an increase in temperature of the ignition plug 100. Further, under conditions such that the temperature of the ignition plug 100 is unlikely to increase as in the case of the evaluation test of FIG. 3, samples Nos. 8 to 10 can restrain the occurrence of defects (e.g., fouling by carbon) caused by low temperature of the ignition plug 100.

Since fouling resistance evaluated by the present evaluation test is related to ease of temperature rise of the ignition plug (particularly, the forward-end-side member portion 300*m*), conceivably, influence of volume difference Dv on fouling resistance is large, whereas influence of other parameters (e.g., Dn, Ls, Ss, Vv, Sa, Sb, Vc, and R1) is relatively small. Therefore, the above-mentioned preferred range of volume difference Dv is conceivably applicable to ignition plugs having various values of parameters (e.g., Dn, Ls, Ss, Vv, Sa, Sb, Vc, and R1). However, volume difference Dv may fall outside the above-mentioned preferred range; for example, volume difference Dv may be greater than 2,000 $mm^3$.

FIG. 4 is a table showing the configurations of samples Nos. 14 to 18 and the test results. This table shows metallic-shell contact area Ss [$mm^2$], solid volume Vv [$mm^3$], metallic-shell exposed area Sa [$mm^2$], insulator exposed area Sb [$mm^2$], space volume Vc [$mm^3$], projected area Sd [$mm^2$], sectional area Se [$mm^2$], second area ratio R2 (=Sd/Se), and test results (unit appears in brackets), with respect to the samples. Samples Nos. 14 to 18 differ in at least one of Sd and Se. By use of samples Nos. 14 to 18, a durability evaluation test to be described herein later was conducted.

FIG. 6(B) is an explanatory view for explaining projected area Sd. The drawing shows the exterior view of a forward direction Df side portion of the ignition plug 100. This exterior view is viewed from a direction perpendicular to the axial line CL. As illustrated, a forward direction Df side portion of the insulator 10 is located on the forward direction Df side of the forward end (herein, the forward end surface 55) of the metallic shell 50. A hatched portion 10*f* is a portion (also called a forward end portion 10*f*) of the insulator 10 disposed on the forward direction Df side of the forward end. (forward end surface 55) of the metallic shell 50. Projected area Sd is of the forward end portion 10*f* projected in a direction perpendicular to the axial line CL onto a plane of projection in parallel with the axial line CL.

In the course of driving of the internal combustion engine, within a combustion chamber, gas (e.g., combustion gas) flows, and a pressure wave propagates via gas. As a result of contact with the insulator 10, the flowing gas and the pressure wave may apply force to the insulator 10. For example, the gas and the pressure wave may move in a direction intersecting with the axial line CL in the vicinity of the forward end portion 10*f* of the insulator 10. As a result of contact with the forward end portion 10*f* of the insulator 10, such gas and the pressure wave can apply force to the insulator 10 in a direction intersecting with the axial line CL. The greater the projected area Sd, the greater the portion of the insulator 10 which receives force from the gas and the pressure wave. Therefore, the greater the projected area Sd, the stronger the force which the insulator 10 receives. The shape of the illustrated forward end portion 10*f* is the same as the shape of the projected forward end portion 10*f*. Therefore, projected area Sd can be calculated by use of such an exterior view.

FIG. 6(C) is an explanatory view for explaining sectional area Se. The drawing shows, at its left, the section of a forward direction Df side portion of the ignition plug 100 which contains the axial line CL. The drawing shows, at its right, a section 10*z* of the insulator 10 taken perpendicularly to the axial line CL. The section 10*z* is taken at the above-mentioned third position P3 (FIG. 5(C)). Sectional area Se is the area of the section 10*z* of the insulator 10. As has been described with reference to FIG. 6(B), force may be applied to the forward end portion 10*f* of the insulator 10 in a direction intersecting with the axial line CL. The insulator 10 is supported by the metallic shell 50 via the packing 8. Therefore, in the case of application of force to the forward end portion 10*f* of the insulator 10, large force is imposed on the insulator 10 at third position P3. Therefore, the greater the sectional area Se of the section 10*z* of the insulator 10 taken at third position P3, the greater the force which the insulator 10 can endure.

Second area ratio R2 appearing in the table of FIG. 4 is the ratio of projected area Sd of the forward end portion 10*f* of the insulator 10 to sectional area Se of the section 10*z* of the insulator 10. A small value of second area ratio R2 indicates a small ratio of projected area Sd of the force-receiving forward end portion 10*f* of the insulator 10 to sectional area Se of the section 10*z* of a force-enduring portion of the insulator 10. That is, the smaller the second area ratio R2, the smaller the force per unit area of the section. 10*z* of the force-enduring portion. Therefore, conceivably, the smaller the second area ratio R2, the greater the improvement of durability.

The outline of the durability evaluation test is as follows. The samples are mounted to a direct-injection turbocharged engine of 1.6 L displacement, and the engine is operated at a rotational speed of 2,000 rpm and a boost pressure of 100 kPa with full throttle opening. Although there are various opinions, there may arise abnormal combustion such that under conditions of such low load and high boost pressure, compounds generated as a result of combustion of oil drops and additives of lubrication oil collected in a piston rod clevis portion self-ignite. As a result of such abnormal combustion, an intensive pressure wave has been propagated within a combustion chamber in some cases. Abnormal combustion which induces such a pressure wave is also called super-knock. In the present evaluation test, a pressure sensor was used to measure pressure within a combustion chamber, and in the event of excessive pressure over a threshold value higher than a regular combustion pressure, the event was judged as the occurrence of abnormal combustion (specifically, super-knock). At the stage in which the number of occurrences of abnormal combustion reached 100, the engine was stopped; the samples were removed from the engine; and then the insulators 10 of the samples were inspected for abnormality. Rating A appearing in the test results of FIG. 4 indicates that the insulators 10 were free of abnormality, and rating B indicates that cracking was found in the insulators 10 of the samples in the vicinity of third position P3.

As shown in FIG. 4, samples Nos. 14 to 16 were evaluated as A, and samples Nos. 17 and 18 were evaluated as B. In this manner, samples Nos. 14 to 16 exhibited good durability as compared with samples Nos. 17 and 18. Also, as shown in FIG. 4, samples Nos. 14 to 16 had a second area ratio R2 of 0.46 or less; specifically, 0.29, 0.35, and 0.46, respectively. Samples Nos. 17 and 18 had a second area ratio R2 of greater than 0.46; specifically, 0.51 and 0.58, respectively. In this manner, in the case of a second area ratio R2 of 0.46 or less, durability was greatly improved as compared with the case of a second area ratio R2 of greater than 0.46. The reason why durability is good in the case of small second area ratio R2 is conceivably as follows: as mentioned above, in the case of small second area ratio R2, force per unit area of the section 10*z* of the force-enduring portion becomes small.

Rating A was realized at a second area ratio R2 of 0.29, 0.35, and 0.46. A preferred range (a range of a lower limit to an upper limit) of second area ratio R2 may be determined by use of these three values. Specifically, any one of the above-mentioned three values may be employed as the upper limit of the preferred range of second area ratio R2. For example, second area ratio R2 may be equal to or less than 0.46. Of these values, any one equal to or smaller than the upper limit may be employed as the lower limit of the preferred range of second area ratio R2. For example, second area ratio R2 may be 0.29 or greater. Conceivably, the smaller the second area ratio R2, the greater the improvement of durability of the insulator 10. Therefore, second area ratio R2 may be smaller than 0.29, which is the smallest value of the above-mentioned three values. The entire forward end portion of the insulator 10 may be disposed on the rearward direction Dfr side of the forward end (herein, the forward end surface 55) of the metallic shell 50. That is, the entire forward end portion of the insulator 10 may be disposed within the through hole 59 of the metallic shell 50. In this case, projected area Sd is zero, and second area ratio R2 is zero. In this manner, projected area Sd may assume various values equal to or greater than zero. Also, second area ratio R2 may assume various values equal to or greater than zero.

Since durability of the insulator 10 evaluated by the present evaluation test is mechanical durability, conceivably, influence of second area ratio R2 on durability is large, whereas influence of other parameters (e.g., Ss, Vv, Sa, Sb, Vc, Sd, and Se) is relatively small. Therefore, the above-mentioned preferred range of second area ratio R2 is conceivably applicable to ignition plugs having various values of parameters (e.g., Ss, Vv, Sa, Sb, Vc, Sd, and Se).

Figures 7, 8:
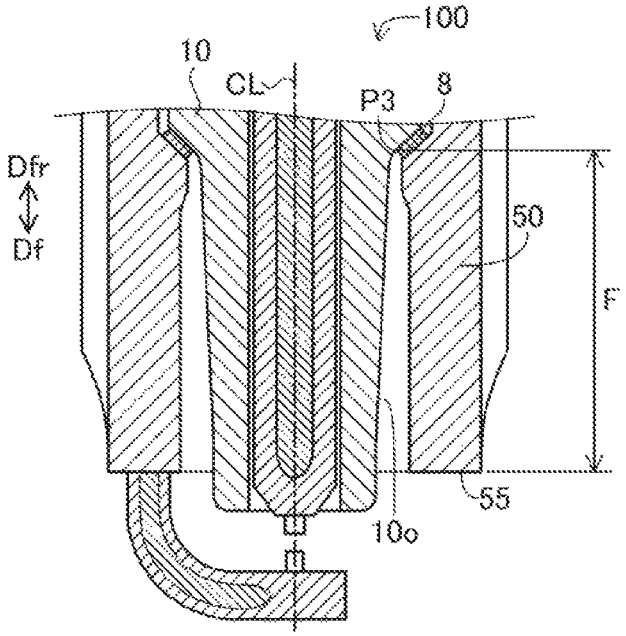
FIG. 7 Explanatory table showing the results of an evaluation test.
FIG. 8 Explanatory view for explaining parameter F.

FIG. 7 is an explanatory table showing the results of an evaluation test conducted by use of ignition plug samples. The drawing contains a table showing the configurations of samples Nos. 19 to 23 and test results. This table shows nominal diameter Dn [mm], screw length Ls [mm], metallic-shell contact area Ss [$mm^2$], metallic-shell exposed area Sa [$mm^2$], insulator exposed area Sb [$mm^2$], first area ratio R1

(=Ss/(Sa+Sb)), distance F [mm], and test results (unit appears in brackets), with respect to the samples. Samples Nos. 19 to 23 differ in distance F. FIG. 8 is an explanatory view for explaining distance F. The drawing shows the section of a forward direction Df side portion of the ignition plug 100 which contains the axial line CL as in the case of FIG. 6(C). Distance F is a distance in a direction in parallel with the axial line CL between the above-mentioned third position P3 and the forward end (herein, the forward end surface 55) of the metallic shell 50. As a result of samples Nos. 19 to 23 an FIG. 7 differing in distance F, samples Nos. 19 to 23 differ in metallic-shell exposed area Sa and insulator exposed area Sb. The samples have the same nominal diameter Dn of 12 mm. Sample No. 21 differs from the other samples in screw length Ls and metallic-shell contact area Ss. Samples Nos. 19 to 23 have a first area ratio R1 of 2.6 or greater, which is the preferred range example having been described with reference to FIGS. 2(A) and 2(B). Samples Nos. 19 to 23 were evaluated for durability of the insulator 10.

In the course of driving of an internal combustion engine, the insulator 10 (FIG. 8) increases in temperature as a result of reception of heat from combustion gas. The packing 8 can transmit heat from the high-temperature insulator 10 to the metallic shell 50. Heat of a portion of the insulator 10 located on the forward direction Df side of a contact portion of the insulator 10 in contact with the packing 8 is transmitted to the metallic shell 50 via the packing 8. As a result, the insulator 10 is cooled. Meanwhile, in the course of driving of the internal combustion engine, combustion of gas and other strokes (e.g., intake of fresh air) are repeated. As a result, temperature rise of the insulator 10 caused by combustion of gas and temperature fall of the insulator 10 on other strokes are repeated. Since a contact portion of the insulator 10 in contact with the packing 8; i.e., a portion of the insulator 10 in the vicinity of third position P3, is easily cooled, at the time of temperature fall, the temperature of the contact portion is apt to drop. Also, since a forward direction Df side portion of the insulator 10 located close to a combustion chamber is close to high-temperature combustion gas, at the time of temperature rise, the temperature of the portion easily increases. Therefore, in the case of third position P3 being located close to the combustion chamber; i.e., in the case of distance F being short, a change in temperature of a portion of the insulator 10 in the vicinity of third position P3 becomes large as compared with the case of distance F being long. Repetition of large temperature change can cause breakage of the insulator 10. Therefore, distance F is preferably long.

The table of FIG. 7 indicates the results of a thermal shock test conducted on the ignition plugs 100. The thermal shock test was conducted as follows. Samples of the ignition plug 100 are mounted into the mounting holes of a water-cooling jacket. The water-cooling jacket is a plate-like member having the mounting holes similar to those of an internal combustion engine. The water-cooling jacket has channels for cooling water and is cooled by cooling water flowing through the channels. In this condition, by use of a blast burner, forward end portions of the ignition plugs 100 protruding from the mounting holes of the water-cooling jacket are heated. By use of a radiation thermometer, the forward ends of the center electrodes are measured for temperature. In the course of heating, the heating power of the burner is adjusted such that the forward ends of the center electrodes have a temperature of 850 degrees C. Heating for one minute by the burner and air cooling for one minute by turning off the burner are repeated. The temperature of cooling water flowing through the water-cooling jacket is adjusted such that the metallic shells 50 of the ignition plugs 100 are maintained at a temperature of 100 degrees C. or less in the course of heating by the burner and in the course of air cooling. One cycle consisting of one-minute heating and one-minute air cooling is repeated 50 times. After completion of 50 cycles of heating and air cooling, the insulators 10 are examined. Rating A in the table of FIG. 7 indicates that the insulator 10 is free of cracking, and rating B indicates the occurrence of cracking in the insulator 10. Cracking occurred in the insulator 10 in the vicinity of a contact portion in contact with the packing 8.

As shown in FIG. 7, samples Nos. 19, 20, and 21 were evaluated as A, and samples Nos. 22 and 23 were evaluated as B. In this manner, samples Nos. 19 to 21 exhibited good durability as compared with samples Nos. 22 and 23. As shown in FIG. 7, samples Nos. 19 to 21 had a distance F of 5.0 mm or more; specifically, 10.0, 7.3, and 5.0 (mm), respectively. Samples Nos. 22 and 23 had a distance F of less than 5.0 mm; specifically, 4.8 and 4.0 (mm), respectively. In this manner, in the case of a distance F of 5.0 mm or more, durability was greatly improved as compared with the case of a distance F of less than 5.0 mm. The conceivable reason for improvement of durability in the case of long distance F is as follows: as mentioned above, in the case of long distance F, a temperature change of a portion (e.g., a contact portion in contact with the packing 8) of the insulator 10 close to third position P3 can be restrained.

Rating A was realized at a distance F of 5.0, 7.3, and 10.0 (mm). A preferred range (a range of a lower limit to an upper limit) of distance F may be determined by use of these three values. Specifically, any one of the above-mentioned three values may be employed as the lower limit of the preferred range of distance F. For example, distance F may be 5.0 mm or more. Of these values, any one equal to or greater than the lower limit may be employed as the upper limit of the preferred range of distance F. For example, distance F may be 10.0 mm or less. Since the longer the distance F, the greater the extent to which a temperature change of a portion of the insulator 10 in the vicinity of third position P3 is restrained, the longer the distance F, the greater the restraint of breakage of the insulator 10. Therefore, distance F may be longer than 10.0 mm which is the greatest one of the above-mentioned three values.

In the present thermal shock test, the temperature of the metallic shell 50 is maintained at 100 degrees C. or less through cooling by the water-cooling jacket. Meanwhile, in ordinary operation of an internal combustion engine, the metallic shell 50 can be maintained at a temperature higher than 100 degrees C. The present thermal shock test can be said to be conducted under severe conditions such that a temperature change is apt to become great as compared with ordinary driving conditions of the internal combustion engine. Therefore, in mounting the ignition plug 100 on an ordinary internal combustion engine, distance F may be less than 5.0 mm.

As shown in FIG. 7, samples Nos. 19 to 23 have a first area ratio R1 of 2.6 or greater. Therefore, under conditions such that the temperature of the ignition plug 100 is apt to increase as in the case of the evaluation test of FIG. 2(A), samples Nos. 19 to 23 can conceivably restrain the occurrence of defects (e.g., preignition) caused by an increase in temperature of the ignition plug 100.

Since durability of the insulator 10 evaluated by the present evaluation test is related to a temperature change of a portion of the insulator 10 in the vicinity of third position P3, conceivably, influence of distance F on durability is large, whereas influence of other parameters (e.g., Dn, Ls, Ss, Vv, Sa, Sb, Vc, R1, Dv, Sd, Se, R2, etc.) is relatively small. Therefore, the above-mentioned preferred range of distance F is conceivably applicable to ignition plugs having various values of parameters (e.g., Dn, Ls, Ss, Vv, Sa, Sb, Vc, R1, Dv, Sd, Se, R2, etc.).

Figure 9:
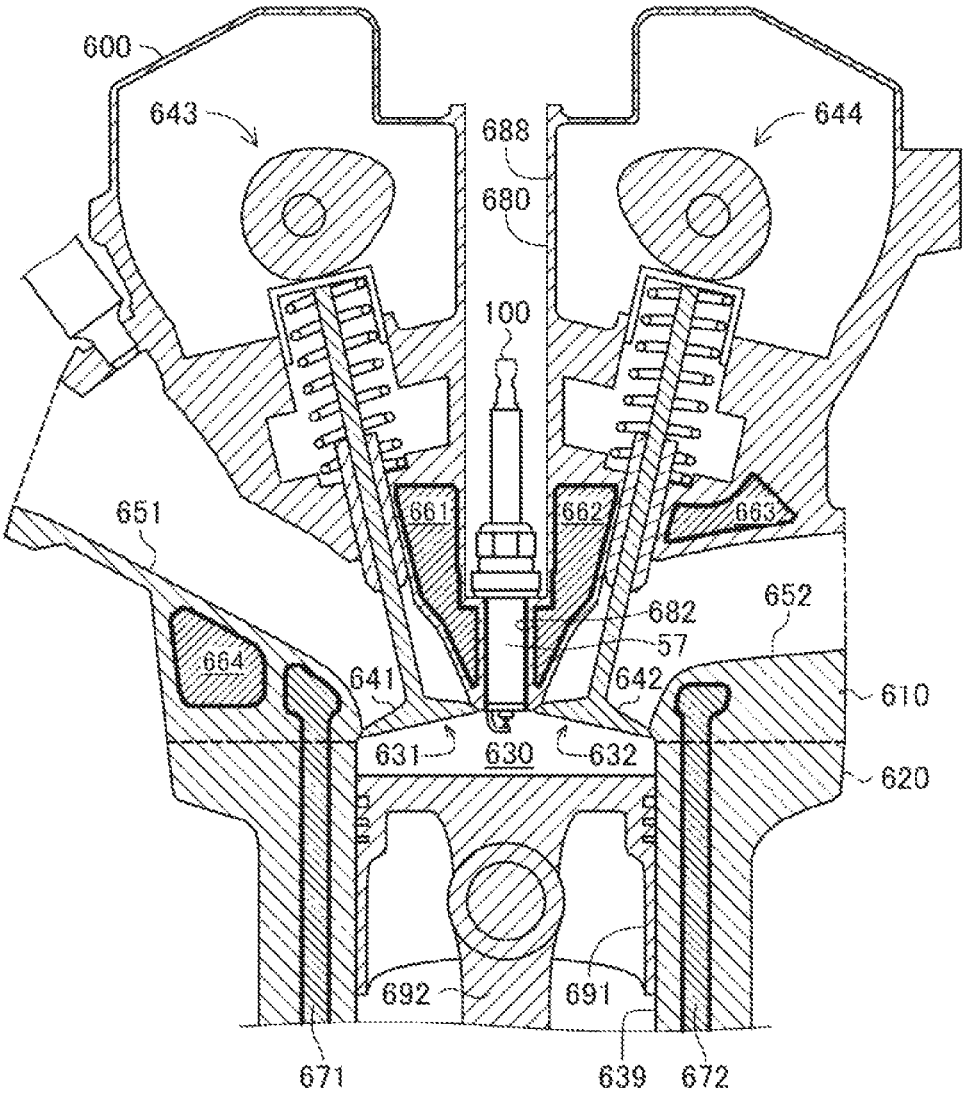
FIG. 9 Schematic view showing the sectional configuration of an internal combustion engine 600 according to an embodiment of the present invention.

C. Internal Combustion Engine System:

C1. Internal Combustion Engine:

FIG. 9 is a schematic view showing the sectional configuration of the internal combustion engine 600 according to an embodiment of the present invention. The drawing shows a portion of a single combustion chamber 630 which includes the mounting hole 680 for the ignition plug 100. The internal combustion engine 600 has a cylinder head 610 and a cylinder block 620. The cylinder block 620 has a cylinder 639 formed therein. A piston 691 is disposed within the cylinder 639. One end of a connecting rod 692 is connected to the piston 691. Although unillustrated, the other end of the connecting rod 692 is connected to a crank shaft.

The cylinder head 610 is disposed on the cylinder block 620. The cylinder head 610 has an intake passage 651 and an exhaust passage 652 provided therein. The cylinder head 610 has an intake port 631 communicating with the intake passage 651, an exhaust port 632 communicating with the exhaust passage 652, and the mounting hole 680 disposed between the intake port 631 and the exhaust port 632, in a region which faces the cylinder 639. The ignition plug 100 is mounted in the mounting hole 680. The drawing shows the schematic exterior view of the ignition plug 100. A cylinder 639 side portion of the hole formation portion 688 forming the mounting hole 680 has a threaded portion 682. The threaded portion 682 is an internal thread and has a spiral thread ridge (not shown). The threaded portion 57 of the ignition plug 100 is screwed into the threaded portion 682 of the hole formation portion 688.

The cylinder head 610 further has an intake valve 641 for opening/closing the intake port 631, a first drive member 643 for driving the intake valve 641, an exhaust valve 642 for opening/closing the exhaust port 632, and a second drive member 644 for driving the exhaust valve 642. The first drive member 643 includes, for example, a coil spring for urging the intake valve 641 in a closing direction, and a cam for moving the intake valve 641 in an opening direction. The second drive member 644 includes, for example, a coil spring for urging the exhaust valve 642 in a closing direction, and a cam for moving the exhaust valve 642 in an opening direction.

The combustion chamber 630 is a space of the cylinder block 620 surrounded by the wall of the cylinder 639, the piston 691, a portion of the cylinder head 610 facing the cylinder 639, the intake valve 641, the exhaust valve 642, and the ignition plug 100.

The internal combustion engine 600 has channels 661 to 664, 671, and 672 through which cooling water flows (such channels are also collectively called a water jacket). Hereinafter, the channels 661 to 664 formed in the cylinder head 610 are also called the head channels 661 to 664, and the channels 671 and 672 formed in the cylinder block 620 are also called the block channels 671 and 672.

The first head channel 661 is provided in the cylinder head 610 between the intake valve 641 and the threaded portion 682 of the mounting hole 680. The second head channel 662 is provided in the cylinder head 610 between the exhaust valve 642 and the threaded portion 682 of the mounting hole 680. These head channels 661 and 662 are provided between the threaded portion 682 of the mounting hole 680 and the valves 641 and 642. Therefore, cooling water flowing through the head channels 661 and 662 can appropriately cool the ignition plug 100 mounted in the mounting hole 680. The third head channel 663 and the fourth head channel 664 are provided in the cylinder head 610 at other positions.

The first block channel 671 and the second block channel 672 are disposed in such a manner as to have the combustion chamber 630 located therebetween. In the example of FIG. 9, these block channels 671 and 672 are formed partially in the cylinder head 610. However, the block channels 671 and 672 may be formed entirely in the cylinder block 620.

Figure 10:
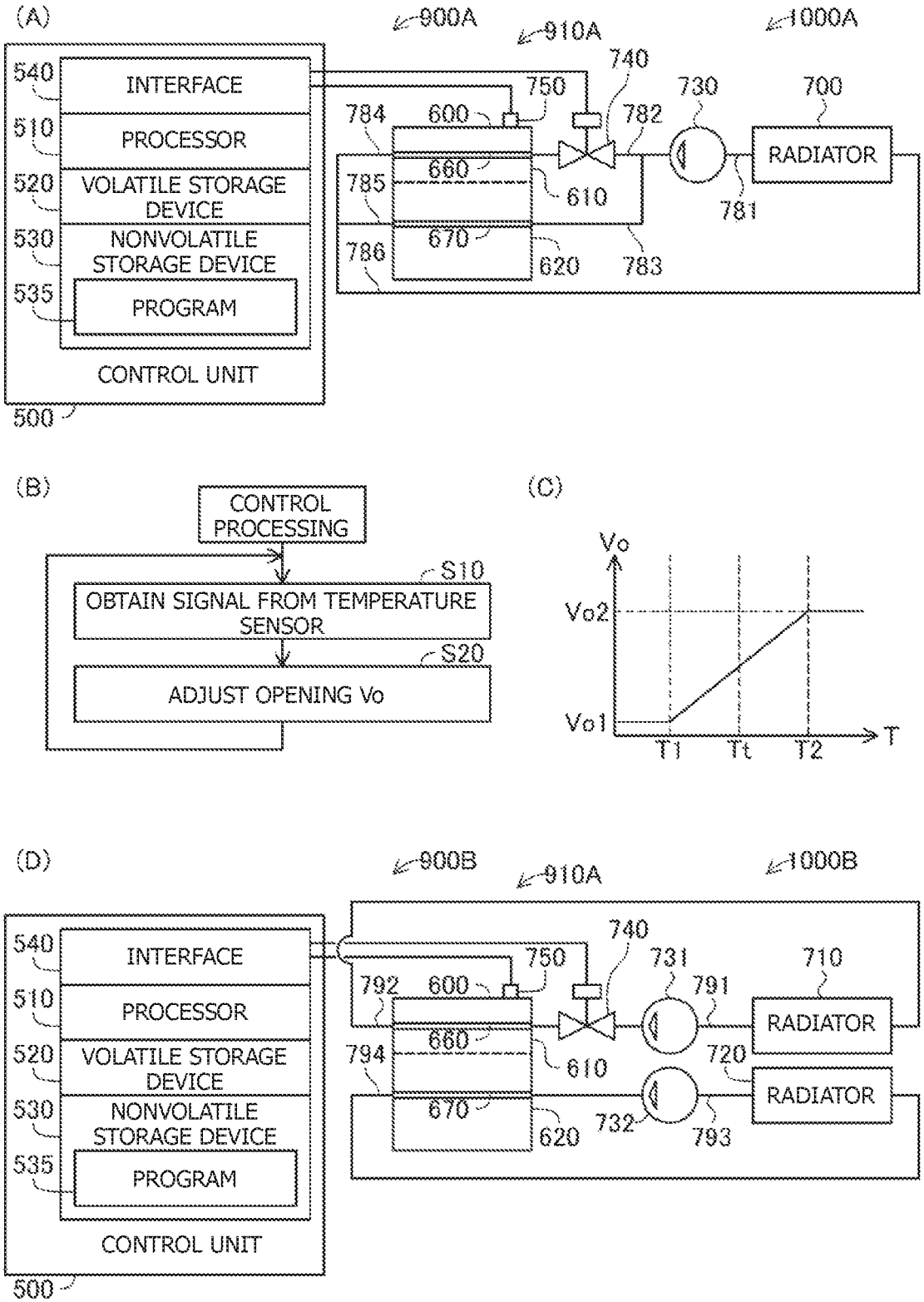
FIG. 10 Explanatory diagrams for explaining an internal combustion engine system.

C2. Internal Combustion Engine System:

FIG. 10(A) is a block diagram showing an example of an internal combustion engine system. An internal combustion engine system 1000A includes the internal combustion engine 600 (FIG. 9), a control system 900A, a radiator 700, a pump 730, and channels 781 to 786. The control system 900A includes a flow control section 910A and a temperature sensor 750. The flow control section 910A includes a control unit 500 and a valve 740. The temperature sensor 750 is, for example, a thermocouple.

The first channel 781 is connected to the downstream side of the radiator 700. The first channel 781 branches into the second channel 782 and the third channel 783. The second channel 782 is connected to the upstream side of a head channel 660 of the internal combustion engine 600, and the third channel 783 is connected to the upstream side of a block channel 670 of the internal combustion engine 600. The head channel 660 represents, as a single channel, a plurality of channels provided in the cylinder head 610 (FIG. 9) and includes, for example, the head channels 661 to 664 of FIG. 9. The block channel 670 represents, as a single channel, a plurality of channels provided in the cylinder block 620 (FIG. 9) and includes, for example, the block channels 671 and 672 of FIG. 9. The fourth channel 784 is connected to the downstream side of the head channel 660, and the fifth channel 785 is connected to the downstream side of the block channel 670. These channels 784 and 785 merge into one another to be connected to the sixth channel 786. The sixth channel 786 is connected to the upstream side of the radiator 700.

The pump 730 is provided in the first channel 781. The pump 730 supplies cooling water cooled by the radiator 700 to the channels 660 and 670 of the internal combustion engine 600 through the channels 781, 782, and 783 and circulates the cooling water output from the channels 660 and 670 of the internal combustion engine 600 to the radiator 700 through the channels 784, 785, and 786. The pump 730 is driven by driving force of the internal combustion engine 600. Alternatively, the pump 730 may include an electric motor as a driving unit.

The temperature sensor 750 is fixed to the internal combustion engine 600 for measuring the temperature of the internal combustion engine 600. The temperature sensor 750 may be fixed to the internal combustion engine 600 at any position where the temperature of the internal combustion engine 600 can be measured. For example, the temperature sensor 750 is fixed to the cylinder head 610. Alternatively, the temperature sensor 750 may be fixed to the cylinder block 620. Also, the temperature sensor 750 may measure the temperature of cooling water flowing through the head channel 660 or the block channel 670. Since the temperature of cooling water correlates with the temperature of the internal combustion engine 600, the temperature sensor 750 which measures the temperature of cooling water can be said to indirectly measure the temperature of the internal combustion engine 600.

The valve 740 is provided in the second channel 782. The valve 740 can control flow per unit time of cooling water flowing through the head channel 660 of the internal combustion engine 600. The smaller the opening of the valve 740, the smaller the flow per unit time of cooling water flowing through the head channel 660 (e.g., the channels 661 and 662 for cooling the ignition plug 100 (FIG. 9)). The control unit 500 controls the opening of the valve 740. The flow control section 910A (the entirety consisting of the control unit 500 and the valve 70) controls flow per unit time of cooling water flowing through the head channels 661 and 662 (FIG. 9) for cooling the ignition plug 100.

The control unit 500 controls the valve 740 in response to a signal from the temperature sensor 750. In the present embodiment, the control unit 500 includes a processor 510 such as CPU, a volatile storage device 520 such as RAM, a nonvolatile storage device 530 such as ROM, and an interface 540 for allowing connection of external devices. A program 535 is stored beforehand in the nonvolatile storage device 530. The valve 740 and the temperature sensor 750 are connected to the interface 540. The processor 510 operates according to the program 535 to thereby control the valve 740.

FIG. 10(B) is a flowchart showing an example of control processing conducted by the control unit 500. In S10, the processor 510 receives a signal from the temperature sensor 750. In S20, the processor 510 adjusts the opening of the valve 740 in response to the signal from the temperature sensor 750. Correlation between the opening of the valve 740 and a measured value (e.g., electric resistance of the sensor element of the temperature sensor 750) indicated by the signal from the temperature sensor 750 (called control correlation) is determined beforehand. Data indicative of control correlation (e.g., lookup table) is incorporated in the program 535. In S20, the processor 510 adjusts the opening of the valve 740 to an opening associated with a measured value indicated by the signal from the temperature sensor 750 according to control correlation. The processor 510 repeatedly executes such S10 and S20.

FIG. 10(C) is a graph showing the relation between temperature T and opening Vo represented by control correlation. The horizontal axis shows temperature T indicated by the signal from the temperature sensor 750, and the vertical axis shows opening Vo of the valve 740. As illustrated, the lower the temperature T, the smaller the opening Vo. Specifically, in the case of temperature T equal to or lower than first temperature T1, opening Vo is first opening Vo1 (herein, Vo1≥zero). In the case of temperature T equal to or higher than second temperature T2, opening Vo is second opening Vo2 (herein, T2>T1, Vo2>Vo1). In a range of temperature T from first temperature T1 to second temperature T2, opening Vo increases continuously with temperature T from first opening Vo1 to second opening Vo2. The processor 510 repeatedly executes S10 and S20 of FIG. 10(B). As a result, in the event of a change in temperature of the internal combustion engine 600, opening Vo of the valve 740 is adjusted to opening Vo associated with temperature T.

In the case of temperature T equal to or lower than a predetermined threshold value Tt between first temperature T1 and second temperature T2, opening Vo is small as compared with the case of temperature T higher than threshold value Tt. Specifically, flow per unit time of cooling water flowing through the head channels 661 and 662 (FIG. 9) for cooling the ignition plug 100 is small. Therefore, in the case of temperature T equal to or lower than threshold value Tt, since overcooling of the ignition plug 100 can be restrained, there can be restrained the occurrence of defects (e.g., fouling by carbon) caused by low temperature of the ignition plug 100. In the case of temperature higher than threshold value Tt, opening Vo is large. Specifically, flow per unit time of cooling water flowing through the head channels 661 and 662 (FIG. 9) for cooling the ignition plug 100 is large. Therefore, since an increase in temperature of the ignition plug 100 can be restrained, there can be restrained the occurrence of defects (e.g., preignition) caused by an increase in temperature of the ignition plug 100.

FIG. 10(D) is a block diagram showing another internal combustion engine system 1000B. Different from the system 1000A of FIG. 10(A), cooling water channels for the head channel 660 are separated from cooling water channels for the block channel 670. Specifically, the internal combustion engine system. 1000B includes the internal combustion engine 600, a control system 900B, a first radiator 710, a second radiator 720, a first pump 731, a second pump 732, and channels 791, 792, 973, and 794. The control system 900B includes the flow control section 910A and the temperature sensor 750. The flow control section 910A includes the control unit 500 and the valve 740. Elements of the internal combustion engine system 1000B similar to those of the internal combustion engine system. 1000A of FIG. 10(A) are denoted by like reference numerals, and repeated description thereof is omitted. For example, the temperature sensor 750 is fixed to the internal combustion engine 600 and measures the temperature of the internal combustion engine 600.

The downstream side of the first radiator 710 and the upstream side of the head channel 660 are connected by the first channel 791, and the downstream side of the head channel 660 and the upstream side of the first radiator 710 are connected by the second channel 792. The first pump 731 and the valve 740 are provided in the first channel 791. The first pump 731 circulates cooling water between the first radiator 710 and the head channel 660. The valve 740 can control flow per unit time of cooling water flowing through the head channel 660.

The downstream side of the second radiator 720 and the upstream side of the block channel 670 are connected by the third channel 793, and the downstream side of the block channel 670 and the upstream side of the second radiator 720 are connected by the fourth channel 794. The second pump 732 is provided in the third channel 793. The second pump 732 circulates cooling water between the second radiator 720 and the block channel 670.

The pumps 731 and 732 are driven by driving force of the internal combustion engine 600. Alternatively, the pumps 731 and 732 may be driven by electric motors.

Similar to the embodiment of FIG. 10(A), the processor 510 of the control unit 500 controls opening Vo of the valve 740 in response to a signal from the temperature sensor 750. Therefore, in the case of temperature T equal to or lower than threshold value Tt, since flow is small, overcooling of the ignition plug 100 can be restrained. Therefore, there can be restrained the occurrence of defects (e.g., fouling by carbon) caused by low temperature of the ignition plug 100. Also, in the case of temperature T higher than threshold value Tt, since flow is large, an increase in temperature of the ignition plug 100 can be restrained. Therefore, there can be restrained the occurrence of defects (e.g., preignition) caused by an increase in temperature of the ignition plug 100.

Figure 11:
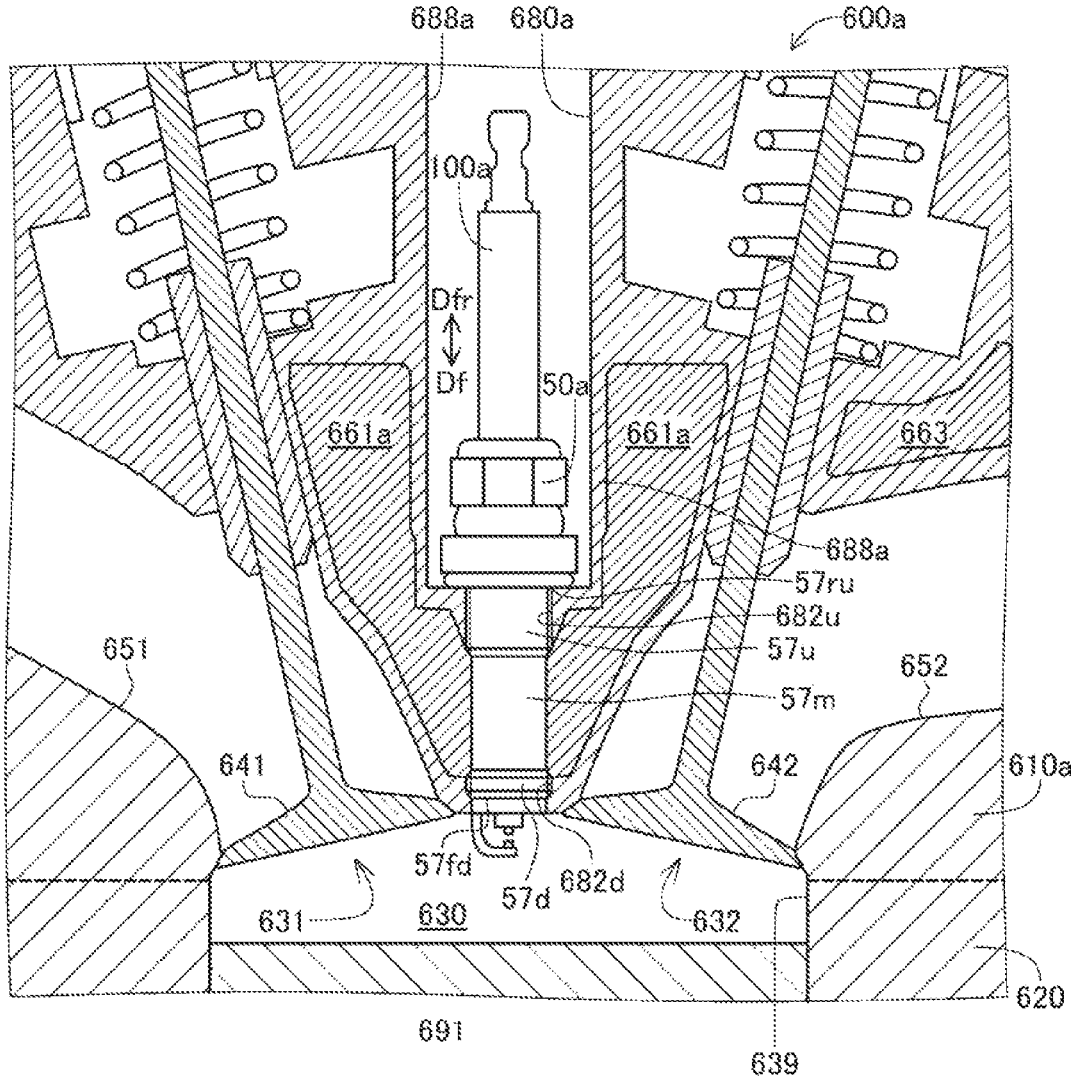
FIG. 11 Schematic view showing the sectional configuration of an internal combustion engine according to another embodiment of the present invention.

D. Another Embodiment, of Internal Combustion Engine:

FIG. 11 is a schematic view showing the sectional configuration of the internal combustion engine of another embodiment. The embodiment of FIG. 11 differs from the embodiment of FIG. 9 in that a mounting hole 680*a* for an ignition plug 100*a* extends through a head channel 661*a*. Configurational features other than the mounting hole 680*a*, the head channel 661*a*, and the spark plug 100*a* are identical to those of the internal combustion engine 600 of FIG. 9. Elements of the internal combustion engine 600*a* identical to those of the internal combustion engine 600 of FIG. 9 are denoted by like reference numerals, and repeated description thereof is omitted.

The head channel 661*a* is provided in a region approximately identical to a region where the head channels 661 and 662 of FIG. 9 are provided. The collective shape of the mounting hole 680*a* and the head channel 661*a* is approximately identical to a shape obtained by eliminating a central portion of the threaded portion 682 of the mounting hole 680 from the collective shape of the mounting hole 680 and the head channels 661 and 662 of FIG. 9 to thereby establish communication between the mounting hole 680 and the head channels 661 and 662.

In the embodiment of FIG. 11, a hole formation portion 688*a* for forming the mounting hole 680*a* has a first threaded portion 682*d* and a second threaded portion 682*u* formed at a cylinder 639 side. These threaded portions 682*d* and 682*u* are internal threads and have spiral thread ridges, respectively. The first threaded portion 682*d* is provided at the same position as that of a cylinder 639 side end portion of the threaded portion 682 of FIG. 9. The second threaded portion 682*u* is provided at the same position as that of an end portion of the threaded portion 682 of FIG. 9 located opposite the cylinder 639 side. A portion of the mounting hole 680*a* between the first threaded portion 682*d* and the second threaded portion 682*u* communicates with the head channel 661*a*.

The drawing schematically shows the exterior view of the ignition plug 100*a* mounted in the mounting hole 680*a*. A metallic shell 50*a* has a first threaded portion 57*d* and a second threaded portion 57*u*. The first threaded portion 57*d* is screwed into the first threaded portion 682*d* of the mounting hole 680*a*, and the second threaded portion 57*u* is screwed into the second threaded portion 682*u* of the mounting hole 680*a*. The outer circumferential surface of a portion of the metallic shell 50*a* between the first threaded portion 57*d* and the second threaded portion 57*u* has a cylindrical shape having no threaded portion.

In this manner, in the embodiment of FIG. 11, the hole formation portion 688*a* for forming the mounting hole 680*a* in which the ignition plug 100*a* is mounted forms the mounting hole 680*a* extending through the head channel 661*a*. A portion (herein, a portion between the first threaded portion 57*d* and the second threaded portion 57*u*) of the metallic shell 50*a* of the ignition plug 100*a* is exposed to the interior of the head channel 661*a*. Therefore, cooling water flowing through the head channel 661*a* can directly cool the metallic shell 50*a* (and, in turn, the spark plug 100*a*). As a result, an excessive increase in temperature of the ignition plug 100*a* can be restrained. Accordingly, there can be restrained the occurrence of defects (e.g., preignition) caused by an excessive increase in temperature of the ignition plug 100*a*.

E. Modified Embodiments:

(1) The ignition plug can employ various configurations other than the above-mentioned configuration. For example, the threaded portion of the metallic shell to be engaged with the thread ridge of the mounting hole of the internal combustion engine may be composed of the two threaded portions 57*d* and 57*u* as in the case of the metallic shell 50*a* of FIG. 11 or may be composed of three or more threaded portions. In any case, preferably, first area ratio R1 (=Ss/(Sa+Sb)) falls within the preferred range having been described with reference to FIG. 2. Further, preferably, volume difference Dv falls within the preferred range having been described with reference to FIG. 3. Also, preferably, second area ratio R2 falls within the preferred range having been described with reference to FIG. 4. Preferably, distance F falls within the preferred range having been described with reference to FIG. 7. Meanwhile, regarding the forward end of the threaded portion to be used for calculation of metallic-shell contact area Ss, the forward end of the most forward direction Df side threaded portion (e.g., in the example of FIG. 11, a forward end 57*fd* of the first threaded portion 57*d*) of a plurality of threaded portions may be employed. Regarding the rear end of the threaded portion to be used for calculation of parameters Ss and Vv, the rear end of the most rearward direction Dfr side threaded portion (e.g., in the example of FIG. 11, a rear end 57*ru* of the second threaded portion 57*u*) of a plurality of threaded portions may be employed.

Also, a discharge gap may be formed between the ground electrode and a side surface (a surface located away from the axial line CL in a direction perpendicular to the axial line CL) of the center electrode. The total number of discharge gaps may be two or more. A magnetic material may be disposed between the center electrode 20 and the metallic terminal member 40. The resistor 74 may be eliminated.

In any case, even in the case of use of thin ignition plugs having a nominal diameter Dn of 12 mm or less of the threaded portion of the metallic shell as in the case of samples Nos. 1 to 13 of FIG. 2(A) and FIG. 3 and samples Nos. 19 to 23 of FIG. 7, the occurrence of defects (e.g., preignition) can be appropriately restrained.

(2) The packing 8 (FIG. 1) may be eliminated from the ignition plug. In this case, the outside-diameter-reducing portion 16 of the insulator 10 may be brought in direct contact with the inside-diameter-reducing portion 56 of the metallic shell 50. Regarding first position P1 to be used for calculation of metallic-shell exposed area Sa, the position of the most forward direction Df side end of that portion of the inner circumferential surface of the metallic shell 50 which is in contact with the outer circumferential surface of the insulator 10 may be used. In this case, usually, first position P1 is the position of the most forward direction Df side end of a contact portion between the inside-diameter-reducing portion 56 of the metallic shell 50 and the outside-diameter-reducing portion 16 of the insulator 10. Regarding third position P3 to be used for calculation of parameters Sb, Vc, Se, and F, the position of the most forward direction Df side end of that portion of the outer circumferential surface of the insulator 10 which is in contact with the inner circumferential surface of the metallic shell 50 may be employed. In this case, usually, third position P3 is the position of the most forward direction Df side end of the contact portion between the inside-diameter-reducing portion 56 of the metallic shell 50 and the outside-diameter-reducing portion 16 of the insulator 10. The same also applies to an ignition plug having another configuration as in the case of the ignition plug 100*a* of FIG. 11.

(3) In the embodiments of FIGS. 10(A) and 10(D), regarding correlation between temperature T and opening Vo represented by control correlation, in place of the correlation shown in FIG. 10(C), various other correlations can be employed. For example, opening Vo may increase monotonically with temperature T. Also, opening Vo may change stepwise with temperature T. In any case, preferably, the higher the temperature T, the larger the opening Vo. In the case where temperature T is low, opening Vo may be set to zero. Specifically, flow per unit time of cooling water flowing through channels (e.g., the head channels 661 and 662 of FIG. 9) for cooling the ignition plug may be adjusted to zero. For example, first opening Vo1 of FIG. 10(C) may be zero.

Regarding the configuration of the flow control section for controlling flow of channels for cooling the ignition plug 100, in place of the configuration including the control unit 500 and the valve 740, any configuration capable of controlling flow can be employed. For example, in the embodiment of FIG. 10(D), the valve 740 may be eliminated, and, instead, an electric motor may be provided for driving the first pump 731. The processor 510 of the control unit 500 may control the electric motor of the first pump 731 such that the higher the temperature T, the higher the rotational speed of the electric motor. In this case, the entirety consisting of the control unit 500 and the first pump 731 equipped with the electric motor corresponds to the flow control section.

Generally, regarding the flow control section, in the case of temperature T equal to or lower than threshold value Tt, there can be employed any configuration capable of reducing flow per unit time of cooling water flowing through channels (e.g., the head channels 661 and 662 of FIG. 9 and the head channel 661*a* of FIG. 11) for cooling the ignition plug, as compared with the case where temperature T is higher than threshold value Tt. Regarding coolant flowing through the channels, any liquid (e.g., oil) can be employed in place of water.

(4) Regarding the configuration of a coolant passage for cooling the ignition plug, any configuration capable of cooling the ignition plug can be employed in place of the configuration of the channels 661 and 662 of FIG. 9 and the configuration of the channel 661*a* of FIG. 11. For example, through employment of channels whose positions in a direction in parallel with the axial line CL of the ignition plug overlie the metallic shell of the ignition plug and whose positions in a direction perpendicular to the axial line CL overlie the cylinder 639, coolant flowing through the channels can appropriately cool the ignition plug. In any case, the coolant passage for cooling the ignition plug may be configured to pass only through the cylinder head 610 or to pass through both of the cylinder head. 610 and the cylinder block 620.

(5) Regarding the configuration of the ignition plug and the configuration of the internal combustion engine, in place of the configurations shown in FIGS. 9 and 11, various other configurations can be employed. For example, the ignition plug 100 of FIG. 1 or 9 may be mounted in the mounting hole 680*a* of the internal combustion engine 600*a* of FIG. 11. Even in this case, a portion (specifically, a portion located between the first threaded portion 682*d* and the second threaded portion 682*u* of the hole formation portion 688*a*) of the threaded portion 57 of the metallic shell 50 is exposed to the interior of the head channel 661*a* and comes into direct contact with coolant.

Regarding the configuration of the internal combustion engine system, in place of the configurations of the systems 1000*a* and 1000B shown in FIGS. 10(A) and 10(D), various other configurations can be employed. For example, in the systems 1000A and 1000E shown in FIGS. 10(A) and 10(B), the internal combustion engine 600*a* of FIG. 11 may be used in place of the internal combustion engine 600.

(6) In the above-mentioned embodiments, a portion of the configuration realized by hardware may be replaced with software; in contrast, a portion or the entirety of the configuration realized by software may be replaced with hardware. For example, the functions of controlling opening Vo of the valve 740 by the control unit 500 shown in FIGS. 10(A) and 10(D) may be implemented by a dedicated hardware circuit.

In the case where the functions of the present invention are implemented partially or entirely by a computer program, the program can be provided while being stored in a computer readable recording medium (e.g., a nontemporary recording medium). The program can be used while being stored in the provided recording medium or a different recording medium (a computer readable recording medium). The "computer readable recording medium" is not limited to portable recording media such as memory cards and CD-ROMs, but includes internal storage devices of computers such as various ROMs, and external storage devices to be connected to computers, such as hard disk drives.

The present invention has been described with reference to the above embodiments and modified embodiments. However, the embodiments and modified embodiments are meant to help understand the invention, but are not meant to limit the invention. The present invention may be modified or improved without departing from the gist and the scope of the invention and encompasses equivalents of such modifications and improvements.

INDUSTRIAL APPLICABILITY

The present invention can be favorably applied to ignition plugs.

DESCRIPTION OF REFERENCE NUMERALS

8: forward-end-side packing; 10: insulator; 10*e*: rear end; 10*f*: forward end portion; 10*i*: inner circumferential surface; 10*o*: outer circumferential surface; 10*q*: opening; 10*x*: exposed portion; 10*z*: section; 11: inside-diameter-reducing portion; 12: through hole (axial hole); 13: rear-end-side trunk portion; 14: large-diameter portion; 15: forward-end-side trunk portion; 16: outside-diameter-reducing portion; 17: forward end; 19: leg portion; 20: center electrode; 20*o*: outer circumferential surface; 21: outer layer; 22: core; 24: head portion; 26: outside-diameter-reducing portion; 27: shaft portion; 29: first tip; 30: ground electrode; 31: outer layer; 32: inner layer; 33: proximal end portion; 34: distal end portion; 37: body portion; 39: second tip; 40: metal terminal member; 41: shaft portion; 48: collar portion; 49: cap attachment portion; 50, 50*a*: metallic shell; 50*f*: forward-end-side portion; 50*i*: inner circumferential surface; 50*x*: exposed portion; 51: tool engagement portion; 52: trunk portion; 53: crimp portion; 54: collar portion; 55: forward end surface; 56: inside-diameter-reducing portion; 57: threaded portion; 57*d*: first threaded portion; 57*f*: forward end; 57*r*: rear end; 57*u*: second threaded portion; 57*fd*: forward end; 57*ru*: rear end; 58: buckled portion; 59: through hole; 61: ring member; 70: talc; 72: first seal; 74: resistor; 76: second seal; 90: gasket; 100, 100*a*: ignition plug; 200: connection member; 300: imaginary forward-end-side portion; 300*f*: forward-end-side space portion; 300*m*: forward-end-side member portion; 500: control unit; 510: processor; 520: volatile storage device; 530: nonvolatile storage device; 535: program; 540: interface; 600, 600*a*: internal combustion engine; 610: cylinder head; 620: cylinder block; 630: combustion chamber; 631: intake port; 632: exhaust port; 639: cylinder; 641: intake valve; 642: exhaust valve; 643: first drive member; 644: second drive member;

651: intake passage; 652: exhaust passage; 660: head channel; 661*a*: head channel; 661: first head channel; 662: second head channel; 663: third head channel; 664: fourth head channel; 670: block channel; 671: first block channel; 672: second block channel; 680, 680*a*: mounting hole; 682: threaded portion; 682*d*: first threaded portion; 682*u*: second threaded portion; 688, 688*a*: hole formation portion; 691: piston; 692: connecting rod; 700: radiator; 710: first radiator; 720: second radiator; 730: pump; 731: first pump; 732: second pump; 740: valve; 750: temperature sensor; 781: first channel; 782: second channel; 783: third channel; 784: fourth channel; 785: fifth channel; 786: sixth channel; 791: first channel; 792: second channel; 793: third channel; 794: fourth channel; 900A, 900B: control system; 910A: flow control section; 1000A, 1000B: internal combustion engine system; g: gap; CL: center axis (CL); Df: forward-end direction (forward direction); and Dfr: rear-end direction (rearward direction).

The invention claimed is:

1. An ignition plug comprising:

a tubular insulator having an axial hole extending in a direction of an axial line;

a metallic shell disposed around an outer circumference of the insulator;

a center electrode disposed in the axial hole of the insulator; and a ground electrode connected to a forward end of the metallic shell and facing the center electrode, wherein the metallic shell has a threaded portion to be engaged with a thread ridge of a mounting hole of an internal combustion engine, and a relational expression $Ss/(Sa+Sb) \geq 2.6$ is satisfied, where Ss is a surface area of an outer circumferential surface of the metallic shell extending from a rear end of the threaded portion to a forward end of the threaded portion, Sa is a surface area of that portion of the metallic shell which is to be exposed to combustion gas of the internal combustion engine;

Sb is a surface area of that portion of the insulator which is to be exposed to the combustion gas; and the metallic shell has an inside-diameter-reducing portion whose inside diameter reduces toward a forward-end side;

the insulator has an outside-diameter-reducing portion whose outside diameter reduces toward the forward-end side;

the ignition plug has a packing in contact with the outside-diameter-reducing portion and with the inside-diameter-reducing portion, or the outside-diameter-reducing portion is in direct contact with the inside-diameter-reducing portion; and a relational expression $F \geq 5.0$ mm is satisfied, where F is a distance in the direction of the axial line from a forward end of a contact portion between the outer circumferential surface of the insulator and the inside-diameter-reducing portion or the packing to the forward end of the metallic shell.

2. An ignition plug according to claim 1, wherein the metallic shell has an inside-diameter-reducing portion whose inside diameter reduces toward the forward-end side;

the insulator has an outside-diameter-reducing portion whose outside diameter reduces toward the forward-end side;

the ignition plug has a packing in contact with the outside-diameter-reducing portion and with the inside-diameter-reducing portion, or the outside-diameter-reducing portion is in direct contact with the inside-diameter-reducing portion; and a relational expression $(Vv-Vc) \leq 2{,}000$ mm$^3$ is satisfied, where Vv is a volume of a forward-end-side portion of the metallic shell ranging from a rear end of the threaded portion to a forward end of the metallic shell and assumed to be solid, and Vc is a volume of that portion of a space between an inner circumferential surface of the metallic shell and an outer circumferential surface of the insulator, which portion is located on the forward-end side of a forward end of a contact portion between the outer circumferential surface of the insulator and the inside-diameter-reducing portion or the packing.

3. An ignition plug according to claim 1, wherein the metallic shell has an inside-diameter-reducing portion whose inside diameter reduces toward the forward-end side;

the insulator has an outside-diameter-reducing portion whose outside diameter reduces toward the forward-end side;

the ignition plug has a packing in contact with the outside-diameter-reducing portion and with the inside-diameter-reducing portion, or the outside-diameter-reducing portion is in direct contact with the inside-diameter-reducing portion;

a forward-end-side portion of the insulator is disposed on the forward-end side of a forward end of the metallic shell; and a relational expression $Sd/Se \leq 0.46$ is satisfied, where Sd is a projected area of that portion of the insulator which is disposed on the forward-end side of the forward end of the metallic shell and is projected in a direction perpendicular to the direction of the axial line, and Se is a sectional area of the insulator taken perpendicularly to the direction of the axial line at a forward end of a contact portion between the outer circumferential surface of the insulator and the inside-diameter-reducing portion or the packing.

4. A control system for controlling an internal combustion engine having an ignition plug according to claim 1 and a coolant passage for cooling the ignition plug, comprising:

a flow control section for controlling a flow per unit time of coolant flowing through the coolant passage; and a temperature sensor for measuring temperature of the internal combustion engine, wherein if the temperature measured by the temperature sensor is equal to or less than a threshold value, the flow control section reduces the flow as compared with a case where the temperature is higher than the threshold value.

5. An internal combustion engine comprising:

a coolant passage through which coolant flows;

a hole formation portion which forms a mounting hole for mounting an ignition plug; and an ignition plug according to claim 1 and mounted in the mounting hole, wherein the hole formation portion forms the mounting hole extending through the coolant passage, and a portion of the metallic shell of the ignition plug is exposed to the interior of the coolant passage.

6. An internal combustion engine system comprising:

an internal combustion engine comprising:

a coolant passage through which coolant flows;

a hole formation portion which forms a mounting hole for mounting an ignition plug; and an ignition plug according to claim 1 and mounted in the mounting hole; and a control system adapted to control the internal combustion engine, the control system comprising:

a flow control section for controlling a flow per unit time of coolant flowing through the coolant passage; and a temperature sensor for measuring temperature of the internal combustion engine, wherein the hole formation portion forms the mounting hole extending through the coolant passage, a portion of the metallic shell of the ignition plug is exposed to the interior of the coolant passage, and if the temperature measured by the temperature sensor is equal to or less than a threshold value, the flow control section reduces the flow as compared with a case where the temperature is higher than the threshold value.

* * * * *